US007019606B2

(12) United States Patent
Williams et al.

(10) Patent No.: US 7,019,606 B2
(45) Date of Patent: Mar. 28, 2006

(54) CIRCUIT BREAKER CONFIGURED TO BE REMOTELY OPERATED

(75) Inventors: Craig B. Williams, Avon, CT (US); Henry H. Mason, Jr., Farmington, CT (US); Roger Castonguay, Terryville, CT (US); Joseph G. Nagy, Southington, CT (US); Heather Pugliese, Amston, CT (US); Narayansamy Soundararajan, Andhra Pradesh (IN); John Dougherty, Collegeville, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/907,296

(22) Filed: Mar. 28, 2005

(65) Prior Publication Data

US 2005/0212629 A1 Sep. 29, 2005

Related U.S. Application Data

(60) Provisional application No. 60/557,226, filed on Mar. 29, 2004.

(51) Int. Cl.
*H01H 83/00* (2006.01)

(52) U.S. Cl. ..... 335/20; 335/68; 335/71; 335/74

(58) Field of Classification Search ..... 335/14, 335/20, 68–77
See application file for complete search history.

(56) References Cited

U.S. PATENT DOCUMENTS

| | | | | |
|---|---|---|---|---|
| 4,456,832 | A * | 6/1984 | Greer et al. | 307/38 |
| 4,623,859 | A | 11/1986 | Erickson | 335/14 |
| 4,679,016 | A | 7/1987 | Ciarcia | |
| 5,180,051 | A | 1/1993 | Cook | 200/400 |
| 5,532,660 | A * | 7/1996 | Smith et al. | 335/14 |
| 5,831,500 | A | 11/1998 | Turner | 335/17 |
| 5,861,784 | A | 1/1999 | Heise | 335/20 |

* cited by examiner

*Primary Examiner*—Lincoln Donovan
(74) *Attorney, Agent, or Firm*—Cantor Colburn LLP

(57) ABSTRACT

A circuit breaker configured to be remotely operated by a controller is disclosed. The circuit breaker includes a set of main contacts, an operating mechanism, a remotely operable drive system configured to open and close the main contacts separate from actuation of the operating mechanism, and a control circuit in operable communication with the main contacts. The drive system includes a motor, and a primary drive responsive to the motor and in operable communication to open and close the main contacts. The control circuit indicates a closed main contact state in response to the operating mechanism being in an on position and the main contacts being closed, and an open main contact state in response to the operating mechanism being in an on position and the main contacts being held open via the drive system.

20 Claims, 19 Drawing Sheets

CIRCUIT BREAKER CONFIGURED TO BE REMOTELY OPERATED

CROSS REFERENCE TO RELATED APPLICATIONS

This application claims the benefit of U.S. Provisional Application Ser. No. 60/557,226, filed Mar. 29, 2004, which is incorporated herein by reference in its entirety.

BACKGROUND OF THE INVENTION

The present disclosure relates generally to circuit breakers, and particularly to circuit breakers configured to be remotely operated.

Electrical panels typically house a plurality of circuit breakers that distribute power from a source to a plurality of loads while providing protection to the load circuits. The electrical panels may be single-phase, three-phase, or three-phase with switching neutral, may have a variety of voltage ratings, such as 120 Vac to 600 Vac for example, and may have a variety of current ratings, such as 125 Amps to 400 Amps for example, thereby enabling the electrical panels to serve a variety of applications. One such application is a lighting panel, which may be used to service lighting loads in a commercial building having a plurality of lighting circuits. To facilitate the efficient utilization of power in such commercial buildings, remote operated circuit breakers (ROCBs) may be employed that enable the lighting loads to be turned on and off from a location remote to the electrical panel or from within the electrical panel. During the operation of a ROCB, it is desirable to be able to rapidly open and rapidly close the main breaker contacts while the main breaker operating mechanism is in the on position. It is also desirable to be able to decouple the ROCB drive system from the main contacts when the main breaker operating mechanism is in the off or tripped position. While different types of ROCBs may employ different types of drive systems, such as solenoids and electric motors for example, not all drive systems lend themselves to perform as desired without the introduction of complex and costly subsystems. Accordingly, there is a need in the art for a ROCB that overcomes these drawbacks.

BRIEF DESCRIPTION OF THE INVENTION

Embodiments of the invention include a circuit breaker configured to be remotely operated by a controller. The circuit breaker includes a set of main contacts, an operating mechanism, a remotely operable drive system configured to open and close the main contacts separate from actuation of the operating mechanism, and a control circuit in operable communication with the main contacts. The drive system includes a motor, and a primary drive responsive to the motor and in operable communication to open and close the main contacts. The control circuit indicates a closed main contact state in response to the operating mechanism being in an on position and the main contacts being closed, and an open main contact state in response to the operating mechanism being in an on position and the main contacts being held open via the drive system.

Other embodiments of the invention include a circuit breaker configured to be remotely operated by a controller. The circuit breaker includes a set of main contacts, an operating mechanism, a remotely operable drive system having a motor and being configured to open and close the main contacts separate from actuation of the operating mechanism, and a control circuit in operable communication with the main contacts and the motor. The motor is configured to be turned on and off via a line control switch and a load control switch. The control circuit includes a dynamic braking circuit connected in series between the line and load control switches and configured to be inactive in response to the motor being turned on and active in response to the motor being turned off.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a remote operated circuit breaker (ROCB) having a unidirectional motor and drive gear that drive a cam and cam follower. The cam follower actuates a crank assembly that serves to charge an opening spring, close the main contacts of the circuit breaker, and open the main contacts of the circuit breaker. The crank assembly interfaces with the main contacts via an intermediate crank and a mechanism crank. The unidirectional drive system of the ROCB is effective to open and close the main contacts only when the circuit breaker operating mechanism is in the on position. In the event that the operating mechanism is in the off or trip position, a decoupler serves to decouple the ROCB unidirectional drive system from the main contacts, thereby preventing the ROCB drive system from operating the main contacts in the event that the circuit breaker is off or tripped. The opening spring and the crank assembly are configured such that the opening and closing action of the main contacts via the ROCB drive system occurs in a quick-make and quick-break fashion. A status indicator flag provides a technician with visual indication of the status of the contacts. A status switch provides status logic to a controller for timely on/off control of power to the motor. A multipole ROCB may be configured by ganging together multiple single pole ROCBs, where only one of the poles, the master pole, which is usually the center pole, has the unidirectional motor. The other poles, the slave poles, are absent the unidirectional motor, being driven instead by a connecting gear that engages with the gear system of the master pole. A common trip bar provides the appropriate logic for common tripping of all poles. To ensure proper alignment and synchronization of all gears in all poles of a multipole ROCB, an alignment clip is used during assembly to position the gears in a set position. Once the multipole ROCB is assembled and operated once, the alignment clip is automatically repositioned out of the way to a non-engaging position. While embodiments described herein depict a ROCB having a specific operating mechanism and main contact structure, it will be appreciated that the disclosed invention may also be applicable to other ROCBs having different operating mechanism and main contact structures.

Figure 1:
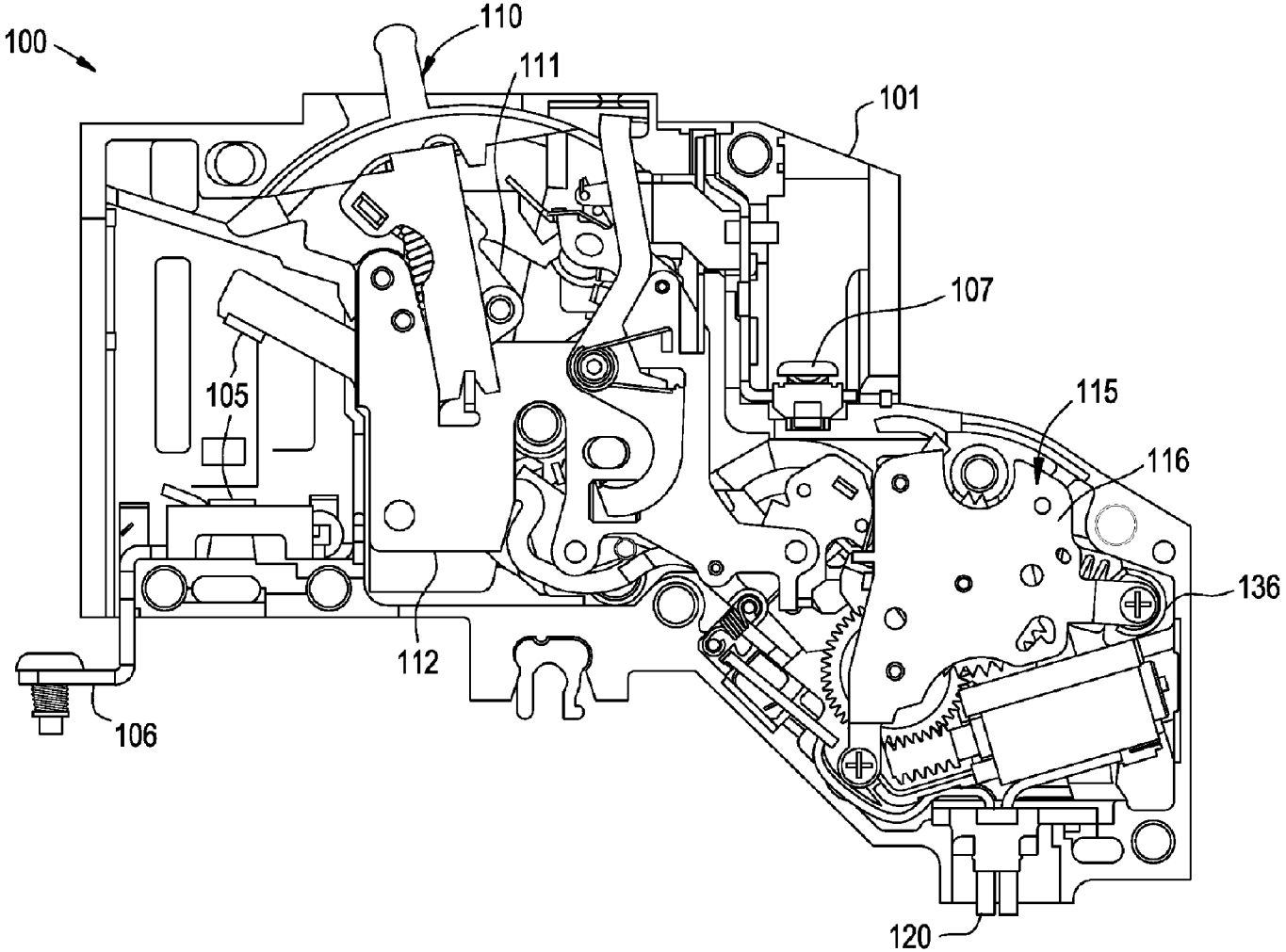
FIG. 1 depicts an exemplary remote operated circuit breaker (ROCB) in accordance with an embodiment of the invention.

FIG. 1 is an exemplary embodiment of a ROCB 100 having a set of main contacts 105 configured to connect between an electrical source (not shown but well known in the art) and an electrical load (not shown but well known in the art) via line and load terminals 106, 107, an operating mechanism 110 in operable communication to open and close the main contacts 105, and a remotely operable drive system 115 (discussed in more detail below) configured to open and close the main contacts 105 separate from actuation of the operating mechanism 110. The drive system 115 receives control signals from a controller 500 (discussed below in reference to FIG. 21) via a communication port 120.

In an exemplary embodiment, operating mechanism 110 operates in a manner described in commonly assigned U.S. Pat. No. 4,679,016, which is incorporated herein by reference in its entirety.

As a general note, and for descriptive purposes, the several figures described herein depict ROCB 100 and various components of ROCB 100 in either a left side view or a right side view. As used herein, a left side view refers to a view from the left pole side of the circuit breaker with the main contacts 105 toward the left side of the figure, and a right side view refers to a view from the right pole side of the circuit breaker with the main contacts 105 toward the right side of the figure. As such, FIG. 1 is considered to be a left side view. Furthermore, operable descriptions of an embodiment of the invention are provided herein with reference to a particular view, which means that a clockwise movement in a left side view is the same as a counter-clockwise movement in a right side view.

Figure 2:
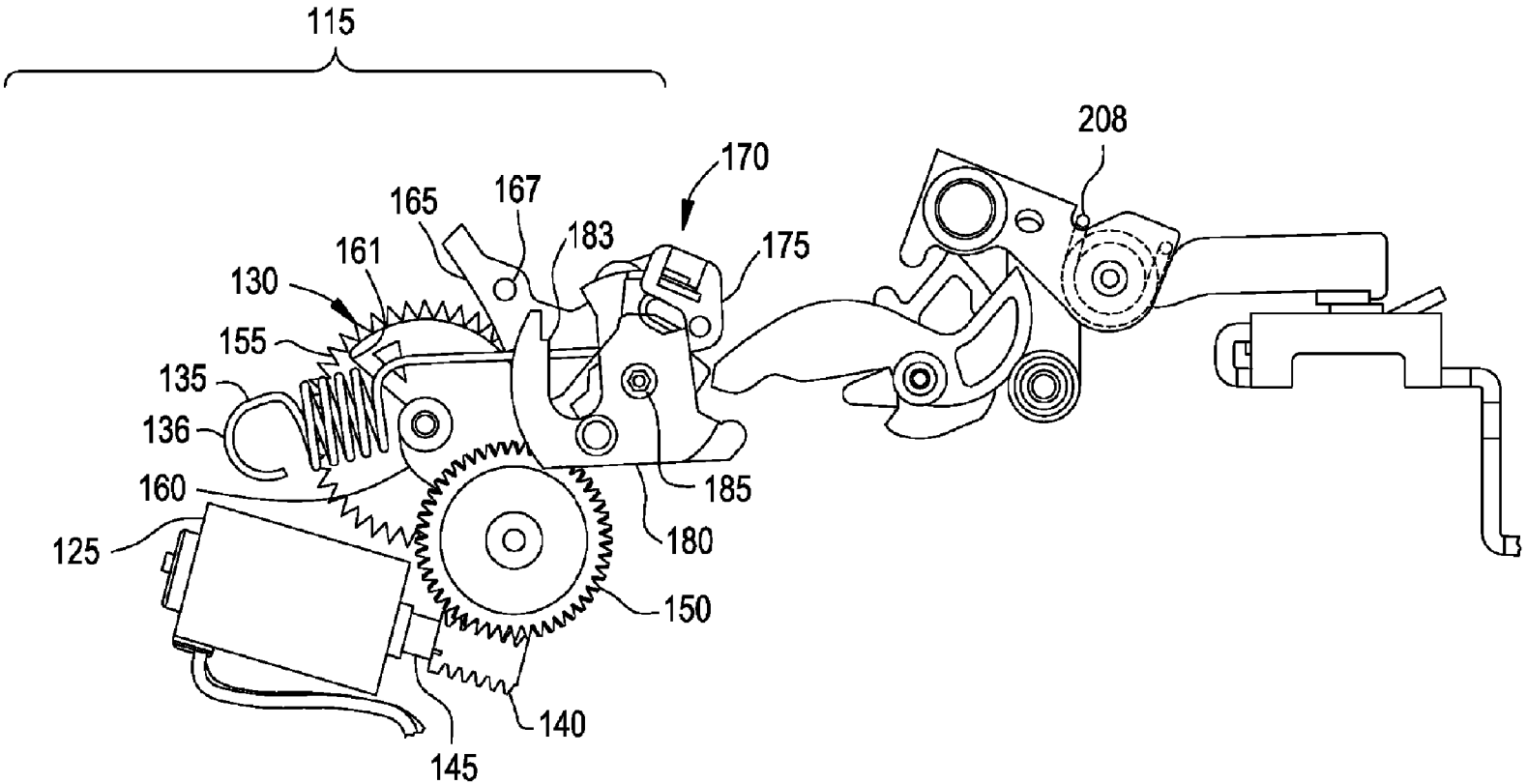
FIG. 2 depicts a portion of the ROCB of FIG. 1 and includes a drive system in accordance with an embodiment of the invention.

Referring now to FIG. 2 (right side view), the drive system 115 includes a unidirectional motor 125 responsive to first and second control signals, a primary drive 130 responsive to the motor 125, and an opening spring 135 responsive to the primary drive 130. As will be discussed in more detail below, the main contacts 105 are responsive to the opening spring 135. The motor 125 has a gear drive, such as a worm drive 140, in fixed relation with the motor shaft 145 that drives the primary drive 130. The primary drive 130 includes a worm gear 150, a cam gear 155 having an integrally arranged cam profile (cam) 160, a cam follower (follower) 165 being biased to follow the cam 160, and a drive crank system 170 responsive to the follower 165, which is best seen by now referring to FIGS. 3–5 collectively.

Figure 3:
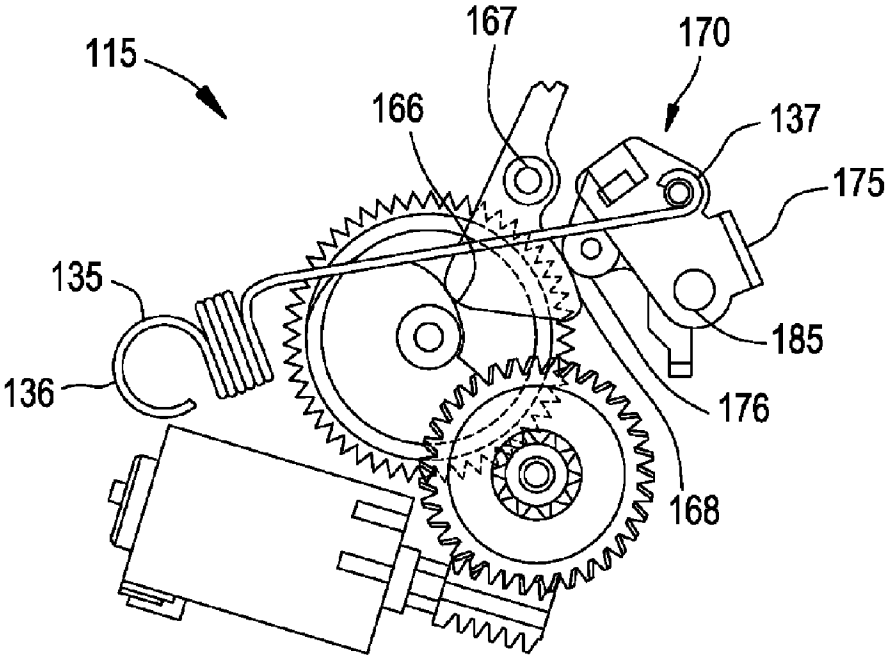
FIG. 3 depicts a portion of the drive system of FIG. 2.
Figure 4:
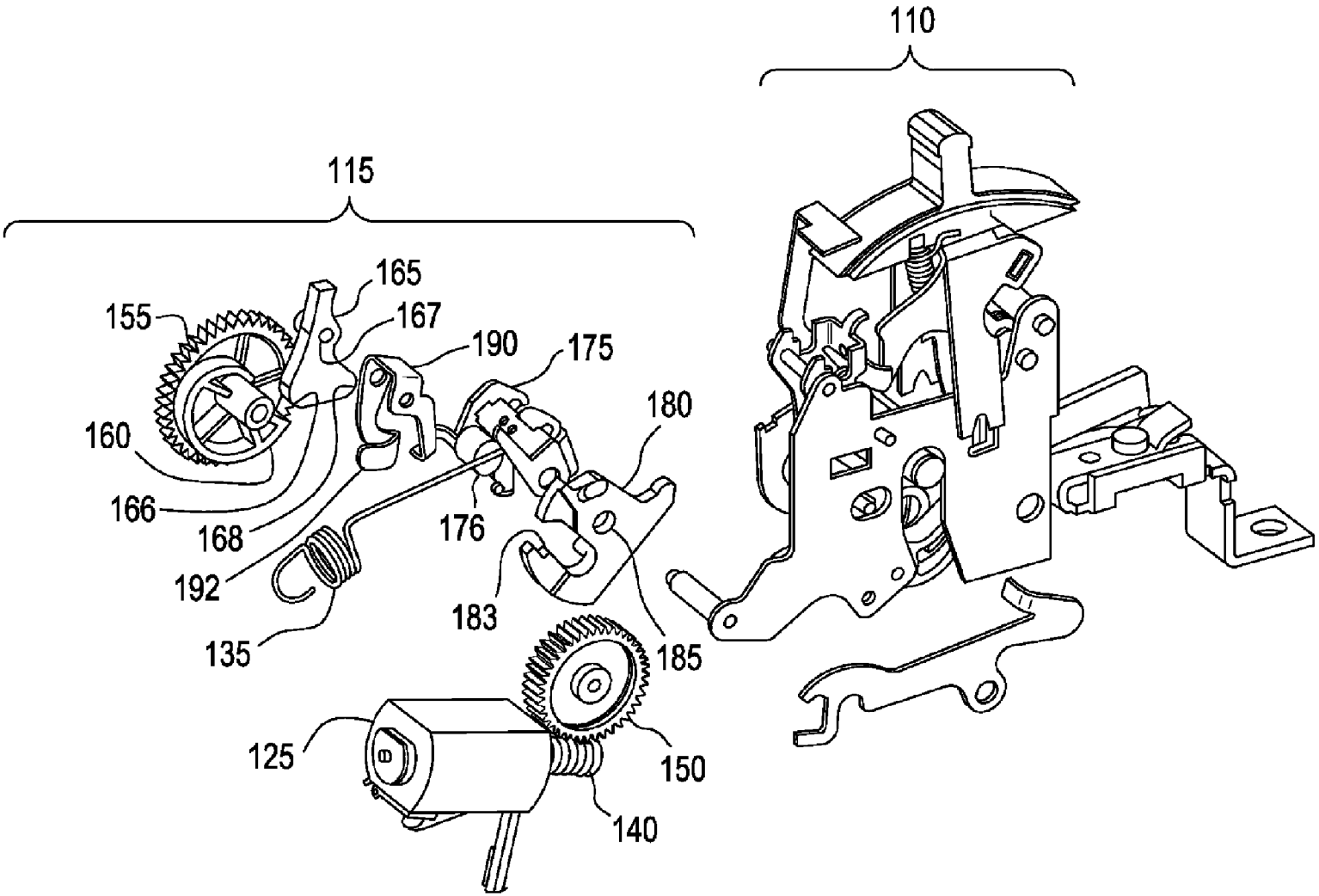
FIG. 4 depicts an isometric exploded assembly view of a portion of the ROCB of FIG. 1 and similar to the portions depicted in FIG. 2.

FIG. 3 (right side view) depicts a partial view of drive system 115 with opening spring 135. FIG. 3 is a partial view in that the drive crank system 170 shows only a first crank 175. A second crank 180 is depicted in FIG. 4 (right side isometric view) and has the same pivot 185 as first crank 175. Second crank 180 is spring biased clockwise with respect to first crank 175 until stop surface 181 of second crank 180 engages a drive plate 195, best seen by referring to FIG. 5 (right side isometric view). Drive plate 195 has one end 196 pivotally arranged with first crank 175, and is spring biased downward such that a central portion 197 engages with pocket 177 of first crank 175. Opening spring 135 has one end 136 anchored to a boss (not shown) in housing 101 (see FIG. 1) and another end 137 anchored to drive crank system 170. Also depicted in FIG. 4 is a blocking prop 190, which will be discussed in more detail below. Unless otherwise specified, all pivotally arranged components are pivotally arranged with respect to a fixed reference, such as the housing 101 of the circuit breaker, or mounting frames therein, for example.

Follower surface 166 of cam follower 165 is biased against cam 160, such that as motor 125 drives worm drive 140, worm gear 150 rotates cam gear 155 clockwise (reference to FIGS. 2–4), causing cam follower 165 to rotate counterclockwise about pivot 167 as surface 166 follows cam profile 160, which causes follower drive surface 168 to drive crank pin 176 that in turn rotates first crank 175 clockwise about pivot 185. As first crank 175 rotates clockwise, opening spring 135 is charged and reaches a full charge when follower 165 rides on the dwell of cam 160.

Figure 5:
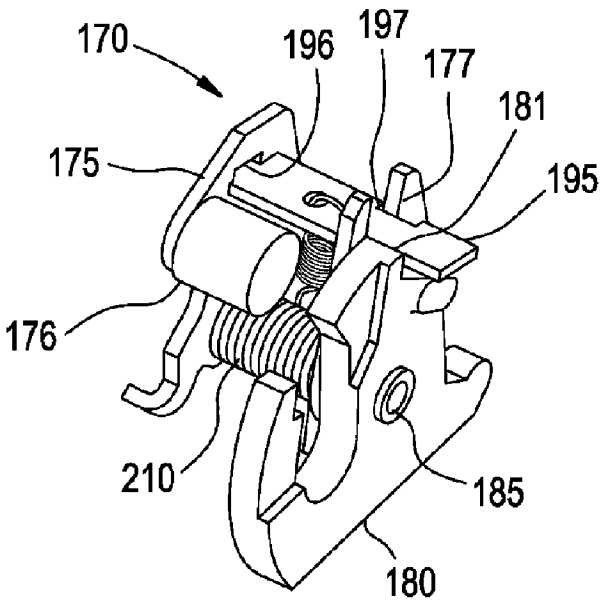
FIG. 5 depicts an isometric view of a drive crank system in accordance with an embodiment of the invention.

In response to the motor 125 receiving an open signal, and in reference now to FIG. 2, cam gear 155 is driven clockwise until cam follower 165 traverses a drop-off shelf 161 on cam 160, at which time opening spring 135 discharges causing drive crank system 170 (both first crank 175 and second crank 180 under the engagement of drive plate 195, best seen by referring to FIG. 5) to rapidly rotate counter-clockwise about pivot 185 independent of the speed of motor 125. During the counter-clockwise rotation of second crank 180, and with reference now to FIG. 6 (right side view), drive surface 182 of second crank 180 engages with a first end 201 of intermediate crank 200 causing intermediate crank 200 to rotate clockwise about pivot 202. A second end 203 of intermediate crank 200 has a cam surface that engages with a roller 206 on contact arm 205, which supports one of the main contacts 105, thereby causing contact arm 205 to rotate counter-clockwise about pivot 207, resulting in main contacts 105 rapidly opening and being held open by intermediate crank 200, drive crank system 170, and opening spring 135. As a result of the aforementioned opening action, a quick break of the main contacts 105 is achieved.

In view of the foregoing description, it will be appreciated that in response to a first control signal (a charge signal) at motor 125, the primary drive 130 (including cam 160 and follower 165) moves to charge the opening spring 135, and in response to a second control signal (an open signal) and with the main contacts 105 being initially closed, the primary drive 130 (also including first and second cranks 175, 180) moves in the same direction to cause the follower 165 to traverse a drop-off shelf 161 that allows the stored energy in the opening spring 135 to rapidly discharge, thereby resulting in the main contacts 105 being rapidly driven open independent of the speed of the motor 125.

Also in response to the first control signal, and with the main contacts 105 starting from a held open condition, the drive system 115 serves to close the main contacts 105, which will now be discussed with primary reference to FIG. 6.

Figure 6:
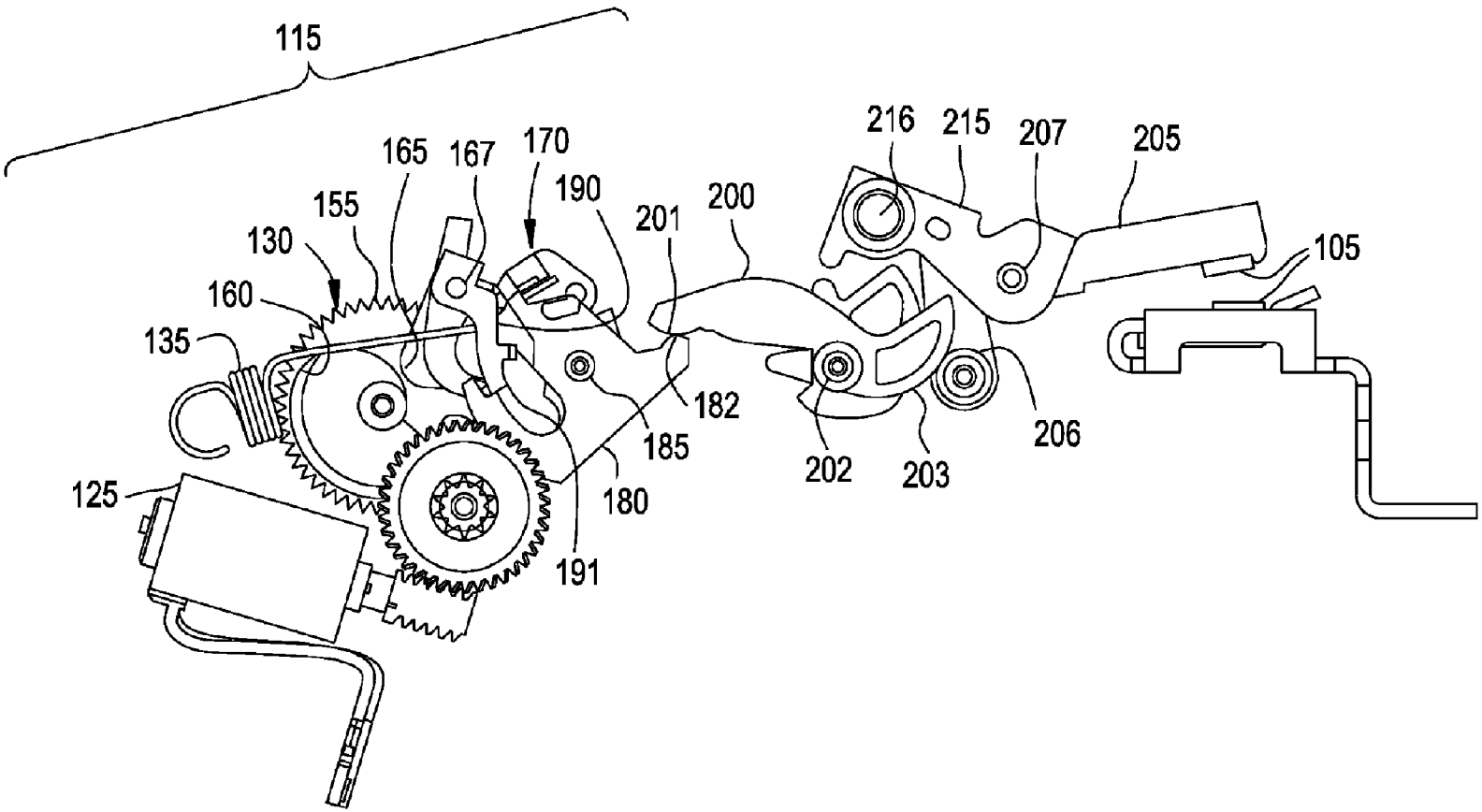
FIG. 6 depicts a view similar to that of FIG. 2, but with components in an alternative position.

In response to motor 125 receiving a first signal (also herein referred to as a charge-and-close signal), and with reference now to FIG. 6, drive system 115 moves to rotate cam gear 155 clockwise such that cam 160 causes cam follower 165 to rotate counter-clockwise about pivot 167, which in turn causes first crank 175 to charge opening spring 135 as discussed previously. However, during this action a catch surface 191 of blocking prop 190 engages with a latch surface 183 (best seen by referring to FIGS. 2 and 4) of second crank 180, thereby preventing second crank 180 from rotating clockwise with first crank 175 and causing crank spring 210 (depicted in FIG. 5) to charge. At a point when cam follower 165 is riding on a dwell of cam 160 and opening spring 135 is fully charged, blocking prop 190 is kicked out of engagement with second crank 180 by way of cam 160 engaging with kick surface 192 (see FIG. 4) to rotate blocking prop 190 counter-clockwise about pivot 167. Since operating mechanism 110 is in the on position, so also is mechanism crank 215, which is coupled to operating mechanism 110 via linkage 111 (depicted in FIG. 1) and is rotated clockwise about pivot 216 to cause a contact spring 208 (depicted in FIG. 2) to be charged and to exert a clockwise bias moment on contact arm 205 about pivot 207. With the removal of the hold condition between blocking prop 190 and second crank 180, intermediate crank 200 is allowed to rotate counter-clockwise about pivot 202 under the influence of the stored energy in the contact spring 208 driving contact arm 205 clockwise about pivot 207, and roller 206 driving against second end 203 of intermediate crank 200. As a result, and under the influence of stored energy in contact spring 208, second crank 180 is driven by roller 206 and intermediate crank 200 to rotate clockwise about pivot 185 resulting in drive surface 182 of second crank 180 being rotated out of the path of first end 201 of intermediate crank 200. As a result of the aforementioned closing action, a quick make of the main contacts 105 is achieved.

In view of the foregoing description, it will be appreciated that in response to the first control signal (a charge-and-close signal), with the main contacts 105 being held open and the operating mechanism 110 being in the on position, the motor 125 causes the drive crank system 170 (including first crank 175 and second crank 180) to move in a direction to charge the opening spring 135 while the blocking prop 190 serves to temporarily block movement of the second crank 180, and in response to the opening spring 135 being fully charged, the motor 125 causes the blocking prop 190 to rapidly release its temporary block of the second crank 180, thereby allowing the stored energy in the contact spring 208 to cause the main contacts 105 to rapidly close under the biasing influence of the contact spring 208 and independent of the speed of the motor 125.

Figure 7:
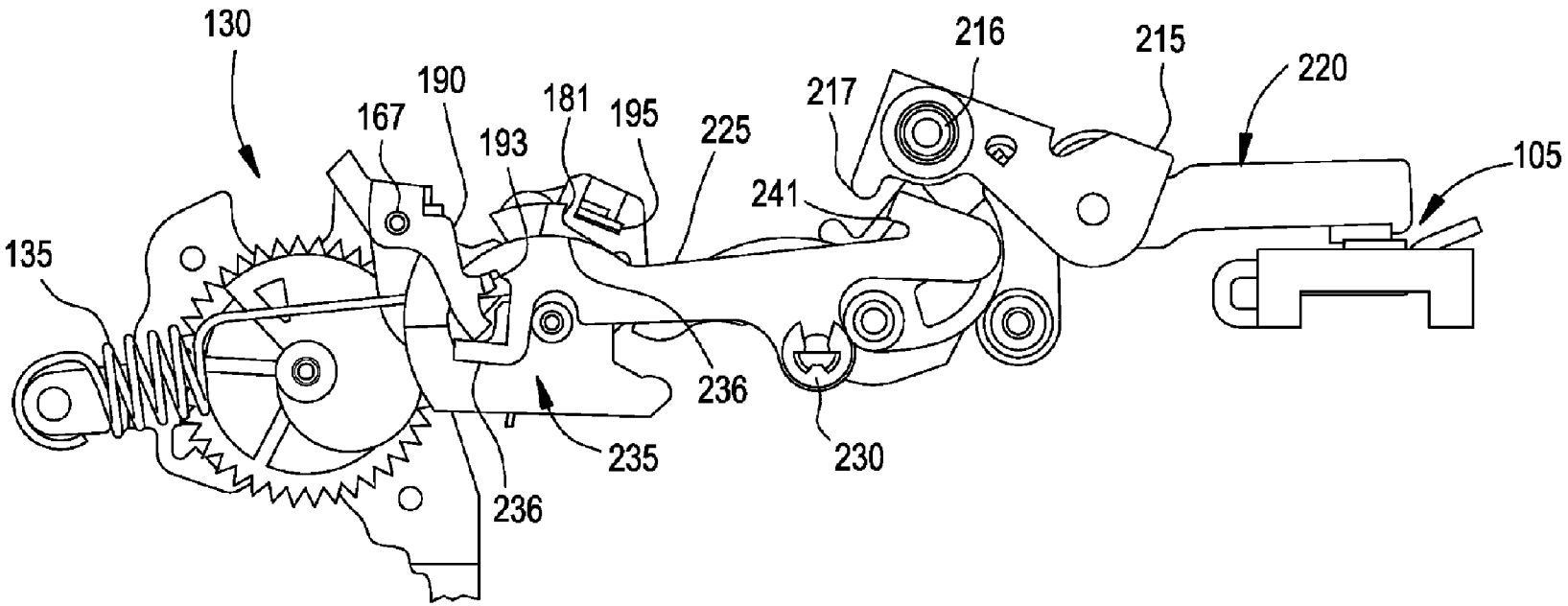
FIG. 7 depicts a view similar to that of FIG. 2, but with a decoupler in accordance with an embodiment of the invention.
Figure 8:
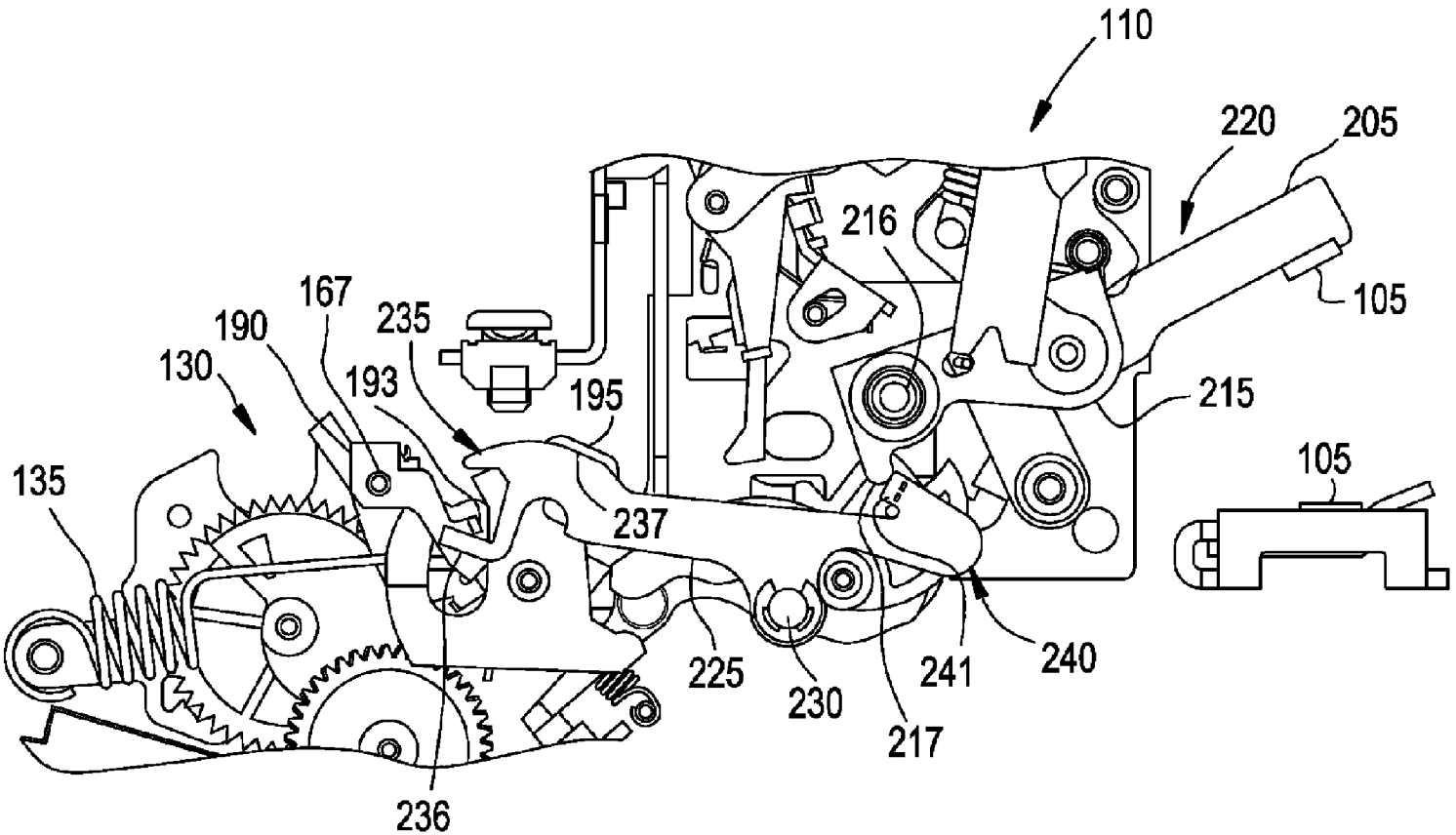
FIG. 8 depicts a view similar to that of FIG. 7, but with components in an alternative position.

Referring now to FIGS. 7 and 8 (right side views), a decoupler system for decoupling the ROCB drive system 115 from the contact arm assembly 220 (contact arm 205, contact spring 208, and mechanism crank 215) will now be discussed. FIG. 7 depicts the operating mechanism 110 in the on position (mechanism crank 215 biased clockwise about pivot 216), the main contacts 105 closed, and the opening spring 135 charged. FIG. 8 depicts the operating mechanism 110 in the off position (mechanism crank 215 biased counter-clockwise about pivot 216), the main contacts 105 open, and the opening spring 135 charged. In both FIGS. 7 and 8, a decoupler 225 rotates about pivot 230 and has a first end 235 that engages with primary drive 130 and a second end 240 that engages with contact arm assembly 220.

Decoupler 225 has an engagement arm 236 at the first end 235 that interfaces with a pick-up tab 193 of blocking prop 190, an engagement surface 237 at the first end 235 that interfaces with drive plate 195 of first crank 175 of drive crank system 170, and an engagement tab 241 at the second end 240 that interfaces with a lobe 217 of mechanism crank 215 (best seen by referring to FIG. 8). As such, decoupler 225 is considered to be in operable communication with the drive crank system 170, the first crank 175, the drive plate 195, the blocking prop 190, and the mechanism crank 215.

In response to operating mechanism 110 being in the on position, and with reference now to FIG. 7, lobe 217 and engagement tab 241 do not engage with each other, and decoupler 225 is free to rotate about pivot 230 until it is stopped by engagement tab 241 hitting a stop surface (not shown but of a configuration known to one skilled in the art) at the mechanism side frame 112 (depicted generally in FIG. 1). As a result, drive plate 195 is fully engaged with pocket 177 of first crank 175, which enables drive plate 195 to engage with stop surface 181 of second crank 180, thereby resulting in the ROCB drive system 115 being operably engaged with the contact arm assembly 220.

In response to the operating mechanism 110 being in the off position, and with reference now to FIG. 8, lobe 217 engages with engagement tab 241 to rotate decoupler 225 clockwise about pivot 230, which causes engagement surface 237 to lift drive plate 195 out of engagement with stop surface 181 of second crank 180, thereby resulting in the ROCB drive system 115 being out of operable engagement with contact arm assembly 220. When decoupled, engagement arm 236 of decoupler 225 also picks up pick-up tab 193 of blocking prop 190, causing blocking prop 190 to rotate counter-clockwise about pivot 167 and out of possible engagement with latch surface 183 of second crank 180, thereby allowing crank spring 210 to bias second crank 180 to move in the same direction as first crank 175.

In view of the foregoing description, it will be appreciated that in response to the operating mechanism 110 being in the on position, the decoupler 225 allows the drive plate 195 to engage the first crank 175 with the second crank 180, which allows engagement of the drive system 115 with the contact arm assembly 220. It will also be appreciated that in response to the operating mechanism 110 being in the off position, the decoupler 225 disallows the drive plate 195 to engage the first crank 175 with the second crank 180, which disallows engagement of the drive system 115 with the contact arm assembly 220, and that in response to the operating mechanism 110 being in the off position and the motor 125 being responsive to the first or the second control signal, the contact arm assembly 220 is non-responsive to the drive system 115. It will be further appreciated that in response to the operating mechanism 110 being in the on position, the decoupler 225 allows the blocking prop 190 to temporarily block the action of the second crank 180 of the drive crank system 170 in response to the drive crank system 170 moving in a direction so as to cause the main contacts 105 to close, and in response to the operating mechanism 110 being in the off position, the decoupler 225 disallows the blocking prop 190 to temporarily block the action of the drive crank system 170 in response to the drive crank system 170 moving in a direction so as to cause the main contacts 105 to close.

The aforementioned discussion has been made with reference to a first control signal (a charge-and-close signal) and a second control signal (an open signal). However, the ROCB drive system 115 also operates by employing motor-off signals, which are controlled using a status switch. In addition to the use of a status switch, a status indicator is employed for providing a user with a visual indication as to the status of the main contacts 105, which will both now be discussed in more detail.

Figure 9:
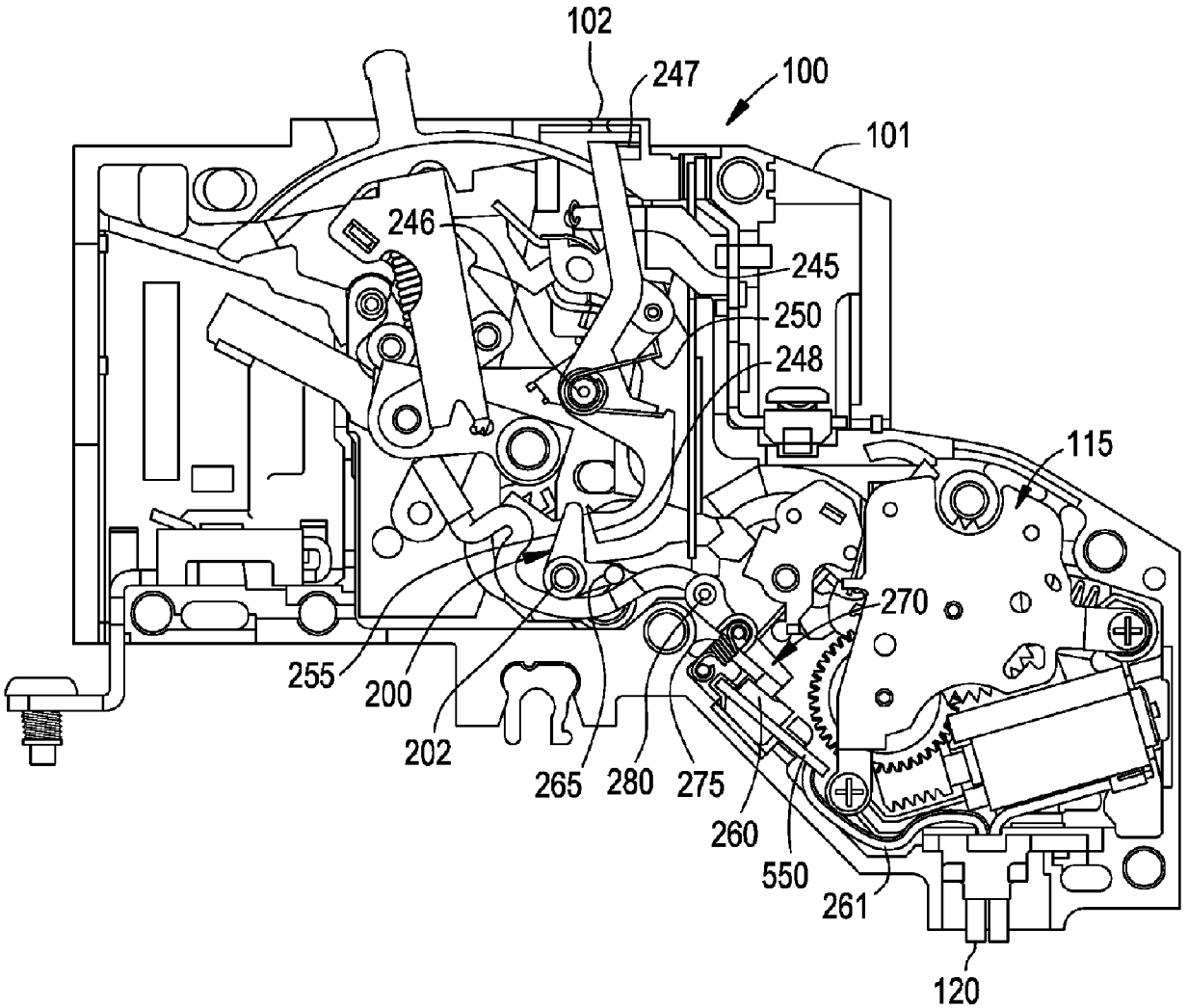
FIG. 9 depicts a view similar to that of FIG. 1, but with parts removed to show further detail.
Figure 10:
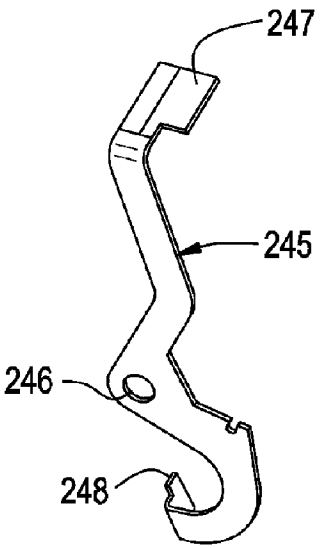
FIG. 10 depicts an isometric view of a status indicator in accordance with an embodiment of the invention.

Referring now to FIG. 9 (left side view), an embodiment of ROCB 100 includes a status indicator 245, also depicted in FIG. 10 (left side isometric view), that is biased via a spring 250 to rotate clockwise about pivot 246 until flag 247 at a top end of status indicator 245 is bottomed out on the housing 101 of ROCB 100. FIG. 9 illustrates the position of status indicator 245 when the operating mechanism 110 of ROCB 100 is in the tripped position. However, as will be discussed in more detail below, FIG. 9 is also illustrative of the position of status indicator 245 when the operating mechanism 110 is in the off position, or is in the on position with the main contacts 105 held open via the drive system 115. Flag 247 is visible to a user via a window 102 in housing 101, and is appropriately color coded to indicate the condition of the main contacts 105, such as green for open and white for closed, for example.

Figure 11:
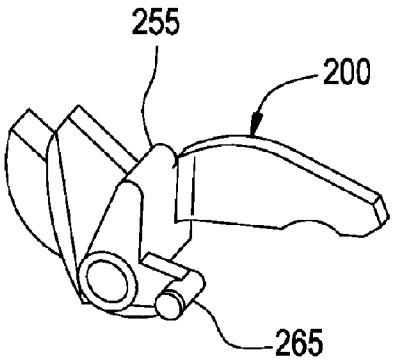
FIG. 11 depicts an isometric view of an intermediate crank in accordance with an embodiment of the invention.

At a bottom end of status indicator 245 is an actuator tab 248 that is disposed to interface with a flag arm 255 of intermediate crank 200, also depicted in FIG. 11 (left side isometric view). When intermediate crank 200 is biased clockwise about pivot 202 (with reference to FIG. 9), flag arm 255 drives status indicator 245 counter-clockwise about pivot 246, which is best seen by referring to FIG. 12 (left side view), thereby changing the position of flag 247 in window 102.

When ROCB drive system 115 is engaged, as described above, intermediate crank 200 rotates counter-clockwise (reference to FIGS. 9 and 12) to open the main contacts 105, and rotates clockwise to close the main contacts 105. Hence, when ROCB drive system 115 is engaged, indicator flag 245 is driven counter-clockwise via flag arm 255 in response to the main contacts 105 being closed, and is driven clockwise via spring 250 in response to the main contacts 105 being open.

When ROCB drive system 115 is disengaged, as described above, intermediate crank 200 is decoupled from drive system 115, but is still positionable by roller 206 of contact arm 205 (see FIG. 6). In response to roller 206, intermediate crank 200 rotates clockwise (reference to FIGS. 9 and 12) in response to main contacts 105 being closed via operating mechanism 110, thereby driving status indicator 245 counter-clockwise, and intermediate crank 200 is free to rotate counter-clockwise (reference to FIGS. 9 and 12) in response to main contacts 105 being open via operating mechanism 110, thereby permitting spring 250 to bias status indicator 245 clockwise.

In view of the foregoing description, it will be appreciated that the status indicator 245 is in operable communication with the intermediate crank 200 and is configured to indicate a closed main contact condition in response to the operating mechanism 110 being in the on position and the main contacts 105 being closed, and to indicate an open main contact condition in response to the operating mechanism 110 being in the on position and the main contacts 105 being held open.

Figure 13:
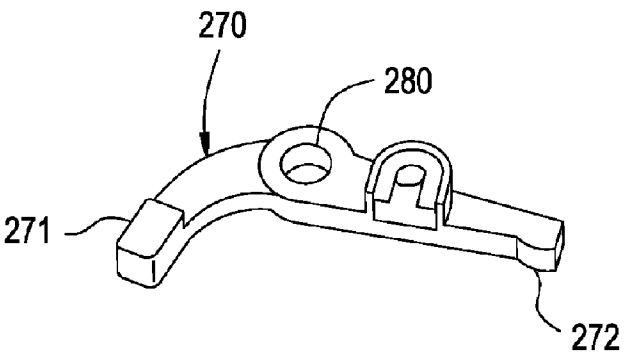
FIG. 13 depicts an isometric view of a switch lever in accordance with an embodiment of the invention.

The above described interaction between intermediate crank 200 and status indicator 245 via flag arm 255, also applies to the interaction between intermediate crank 200 and a status switch 260 (depicted in FIGS. 9 and 12) via switch arm 265 of intermediate crank 200 and a switch lever 270. Switch lever 270, also depicted in FIG. 13 (left side isometric view), is biased via spring 275 to rotate clockwise (with reference to FIGS. 9 and 12) about pivot 280. In response to intermediate crank 200 being driven to rotate clockwise (with reference to FIGS. 9 and 12), switch arm 265 of intermediate crank 200 interacts with first end 271 of switch lever 270 to cause switch lever 270 to rotate counter-clockwise about pivot 280, thereby causing second end 272 of switch lever 270 to disengage with status switch 260. In response to intermediate crank 200 being allowed to rotate counter-clockwise (with reference to FIGS. 9 and 12), switch lever 270 is biased via spring 275 to rotate clockwise about pivot 280, thereby causing second end 272 of switch lever 270 to engage with status switch 260. In an embodiment, the switching signal provided by status switch 260 provides control logic to the controller 500 via wires 261 and communication port 120 for the controller 500 to timely provide a motor-off signal to motor 125. In another embodiment, the switching signal provided by status switch 260 also provides remote indication of the status of the main contacts 105.

For example, with ROCB drive system 115 engaged and a charge-and-close signal present at motor 125, drive system 115 operates in the manner described above to charge opening spring 135 and close the main contacts 105. In response to the blocking prop 190 releasing its temporary hold of second crank 180, intermediate crank 200 is now free to move under the influence of roller 206. With the movement of intermediate crank 200, not only are main contacts 105 committed to close, but also flag arm 255 and switch arm 265 are committed to drive status indicator 245 and status switch 260, respectively. It is this timely change of state of status switch 260 that provides logic to the controller 500 to send a motor-off signal to motor 125, thereby stopping the motor 125 from continuing to run through another cycle.

Similarly, with ROCB drive system 115 engaged and an open signal present at motor 125, drive system 115 operates in the manner described above to discharge the stored energy in opening spring 135 to open the main contacts 105. In response to the intermediate crank 200 rapidly moving to drive the main contacts 105 open via roller 206, so the flag arm 255 and the switch arm 265 also rapidly move to disengage with the status indicator 245 and status switch 260, respectively. It is this timely change of state of status switch 260 that provides logic to the controller 500 to send a motor-off signal to motor 125, thereby stopping the motor 125 from continuing to run through another cycle.

In view of the foregoing description, it will be appreciated that the status switch 260 is in operable communication with the intermediate crank 200 and is configured to indicate a closed main contact state in response to the operating mechanism 110 being in the on position and the main contacts 105 being closed, and is also configured to indicate an open main contact state in response to the operating mechanism 110 being in the on position and the main contacts 105 being held open via the ROCB drive system 115.

It will also be appreciated that in response to the operating mechanism 110 being in the on position and the main contacts 105 being driven open via the ROCB drive system 115 and the intermediate crank 200, the intermediate crank 200 is configured to reposition the status switch 260, thereby causing the status switch 260 to change state in response to operation of the motor 125 and to a change of state at the main contacts 105.

Figure 14:
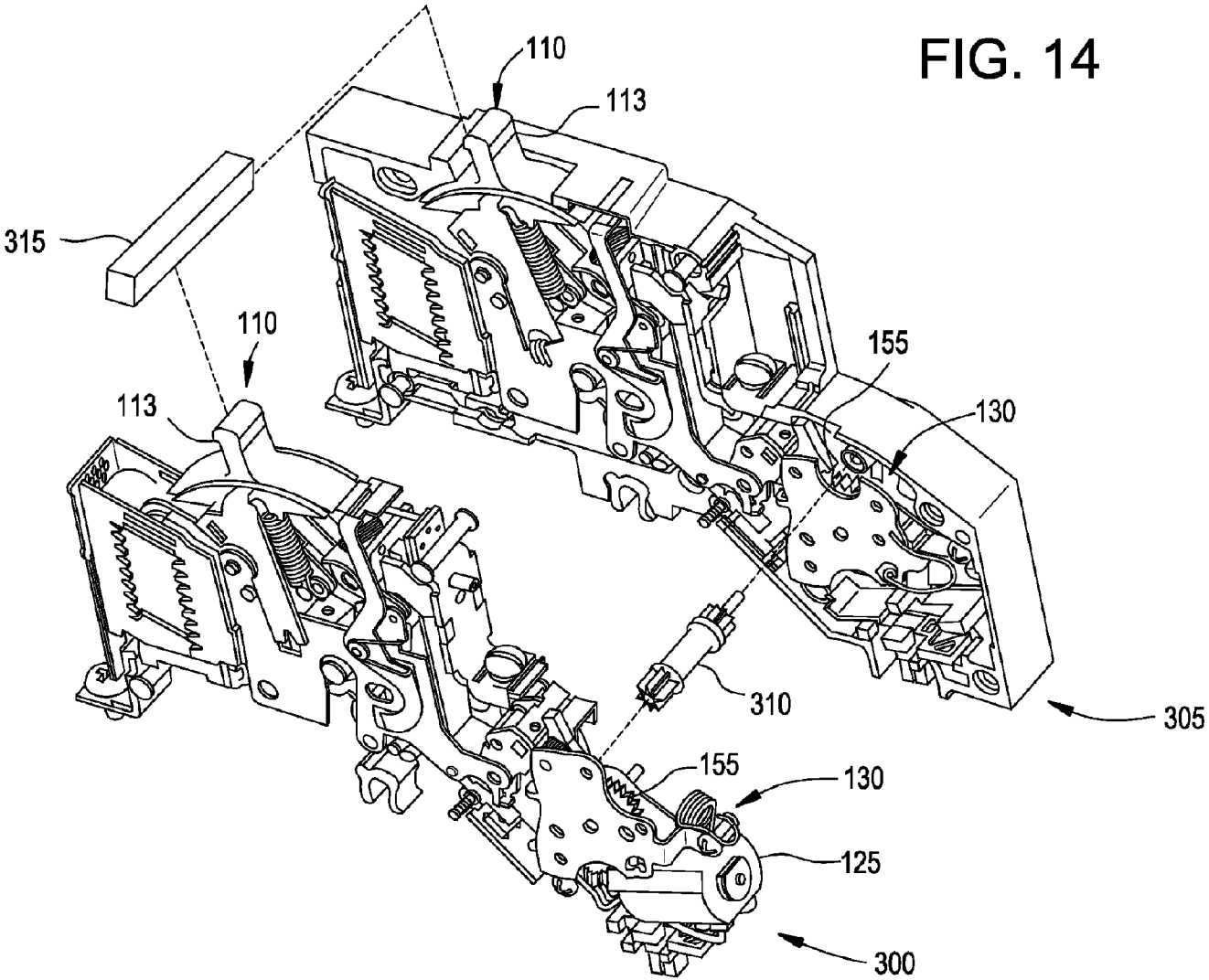
FIG. 14 depicts portions of a multi-pole ROCB in accordance with an embodiment of the invention.
Figure 15:
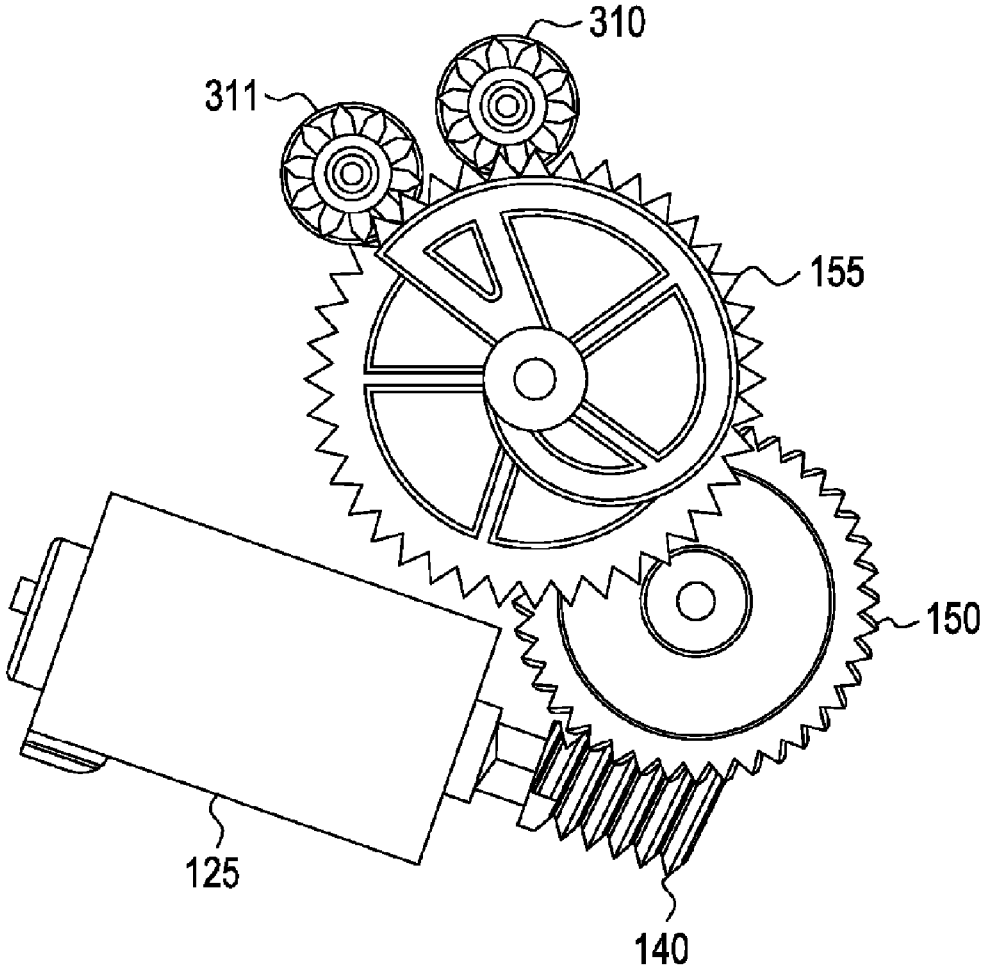
FIG. 15 depicts a portion of a multi-pole ROCB drive system in accordance with an embodiment of the invention.

As previously discussed and with reference now to FIG. 14 (left side isometric view), ROCB 100 may be of a single pole configuration or a multi-pole configuration. In a multi-pole configuration, ROCB 100 is configured with a master pole 300 and slave poles 305 (one slave pole on a two-pole breaker, and two slave poles on a three-pole breaker, for example), with the master pole 300 having a drive motor 125 and the slave poles being absent a motor 125. To provide mechanical ROCB drive from the master pole 300 to the slave pole 305, a connecting gear 310 is used to engage between the cam gears 155 of the primary drives 130. FIG. 15 (right side view) illustrates a three-pole configuration of partial primary drives 130 having two connecting gears 310 and 311. To provide mechanical connection between operating mechanisms 110 of the master and slave poles 300, 305, a mechanism handle tie 315 is used to mechanically tie the operating handles 113 together. By employing a single motor 125 in the master pole 300 and a connecting gear 310 between master and slave poles 300, 305, first and second control signals at motor 125 serve to remotely open and close the master and slave main contacts 105 separate from actuation of the master and slave operating mechanisms 110, in the manner previously discussed.

Figure 16:
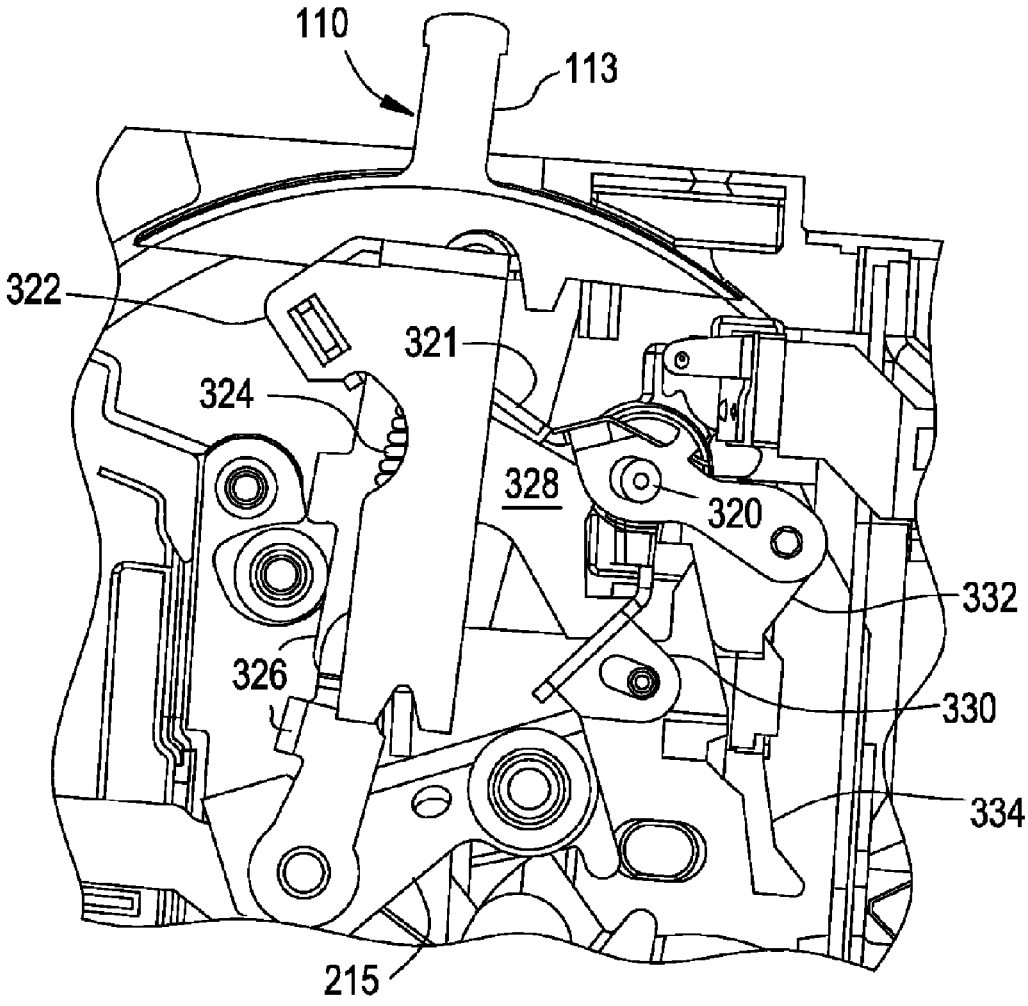
FIG. 16 depicts a portion of a breaker operating mechanism in accordance with an embodiment of the invention.
Figure 17:
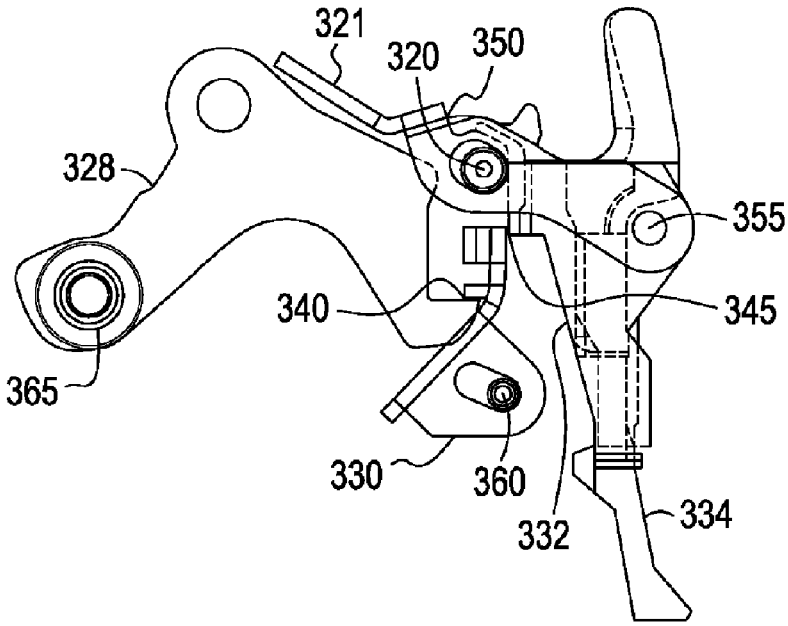
FIG. 17 depicts a portion of the operating mechanism of FIG. 16.
Figure 18:
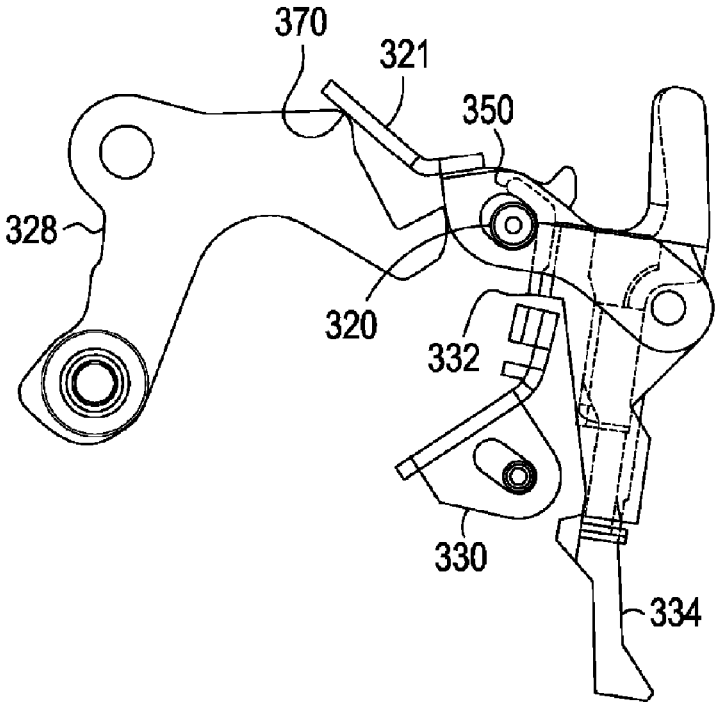
FIG. 18 depicts a view similar to that of FIG. 17, but with components in an alternative position.

To facilitate synchronized tripping of all poles of a multi-pole ROCB 100 and with reference now to FIGS. 16–18 (left side views), a common trip bar 320 and trip cam 321 are employed. Common trip bar 320 is common to all poles and is operably engaged with each trip cam 321 of each pole. FIG. 16 depicts a partial view of operating mechanism 110 having an operating handle 113, a handle yoke 322, mechanism springs 324, linkages 326, mechanism crank 215, cradle 328, primary latch 330, secondary latch 332, and trip lever 334, all of which operate in the manner described in aforementioned U.S. Pat. No. 4,679,016. Also depicted in FIG. 16 (and FIGS. 17–18) is common trip bar 320 and trip cam 321, which operate in a manner best described with reference now to FIGS. 17 and 18 that depict partial views of operating mechanism 110 in the latched position and the tripped position, respectively.

With reference first to FIG. 17 (latched condition), cradle 328 engages with primary latch 330 at engagement point 340, and primary latch 330 engages with secondary latch 332 at engagement point 345. In the latched condition, cradle 328 does not interface with trip cam 321, and common trip bar 320 does not interface with a tab 350 on secondary latch 332. Common trip bar 320 is in operable engagement with trip cam 321, such that common trip bar 320 moves in response to movement of trip cam 321. During a trip action, trip lever 334 and secondary latch 332 rotate clockwise about pivot 355 causing a separation at engagement point 345, primary latch 330 rotates clockwise about pivot 360 causing a separation at engagement point 340, and cradle 328 rotates counter-clockwise about pivot 365, resulting in a trip condition best seen by now referring to FIG. 18.

With reference now to FIG. 18, and during the aforementioned trip action, the counter-clockwise rotation of cradle 328 causes cradle 328 to engage with trip cam 321 at engagement point 370, which causes trip cam 321 to rotate clockwise about pivot 355 (common pivot with secondary latch 332), which causes common trip bar 320 to also move in a rotational path clockwise about pivot 355, which causes common trip bar 320 to engage with tab 350 on a secondary latch 332 of an adjacent pole, which results in synchronized tripping of all poles.

In view of the foregoing description, it will be appreciated that the common trip bar 320 is in operable communication with each operating mechanism 110 of each pole of a multi-pole ROCB 100 such that a trip action at one operating mechanism 110 results in a trip action at each operating mechanism 110 of the multi-pole ROCB 100.

In a multi-pole ROCB 100 where only a single motor 125 is employed to drive more than one set of gears in primary drives 130, such as that depicted in FIG. 14, the cam gears 155 need to be properly aligned from one pole to the next. To facilitate the proper alignment of the cam gears 155, a locking member (or alignment clip) 375 is employed in a slave pole 305, which is best seen by now referring to FIGS. 19 and 20 (left side views).

During the assembly of a master pole 300 and before the motor 125 is installed in housing 101, the cam gear 155 is rotated until the follower 165 is positioned against the drop-off shelf 161 of the cam 160, which is herein referred to as the set position. Once the cam gear 155 is in the set position, the motor 125, with worm drive 140 attached, is installed, thereby locking the master pole 300 in the set position.

Figure 19:
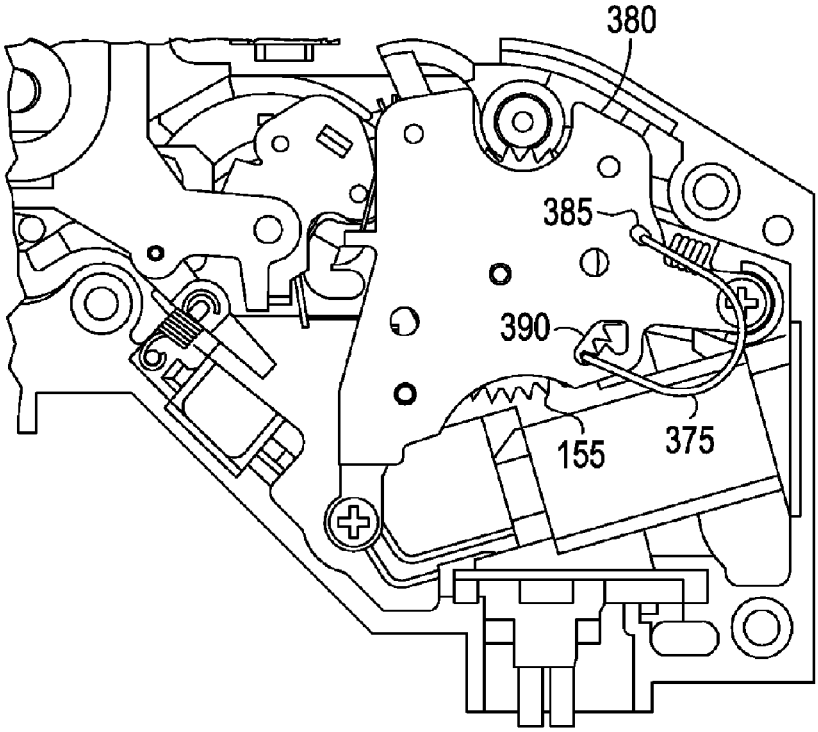
FIG. 19 depicts a locking member in accordance with an embodiment of the invention.
Figure 20:
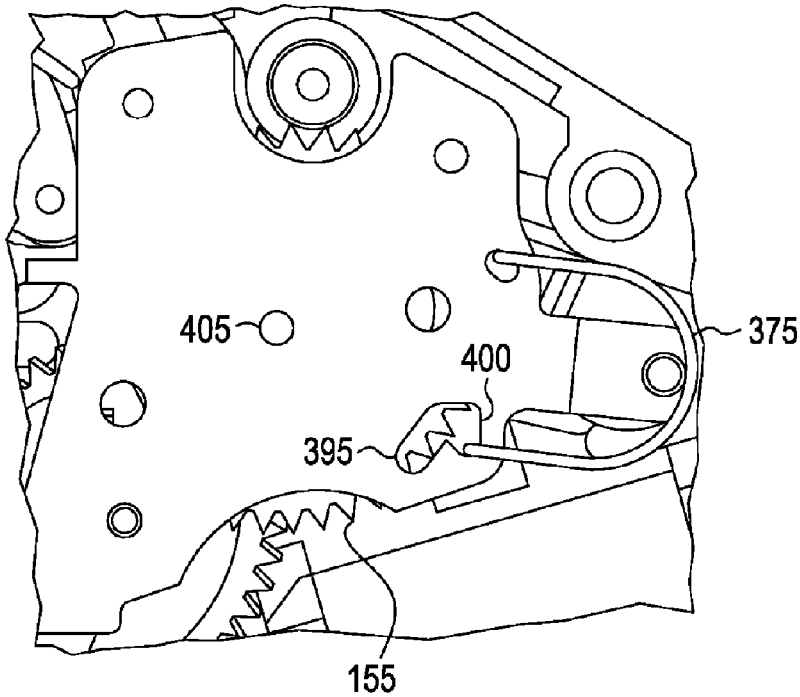
FIG. 20 depicts a view similar to that of FIG. 19, but with components in an alternative position.

During the assembly of the slave pole 305, which is absent a motor 125, the cam gear 155 is likewise rotated to the set position, and then the locking member 375 is installed in a first position that engages with and locks the cam gear 155 in place. This first locked position is depicted in FIG. 19. As part of the primary drive 130 of a slave pole 305, a gear support frame 380 is used to not only support the various gears, but also to provide spring supports 385, 390 for receiving the spring ends of locking member 375. In an embodiment, spring support 385 is a single hole, and spring support 390 is a bilobular hole having a first lobe 395 disposed proximate teeth of cam gear 155 and a second lobe 400 disposed away from teeth of cam gear 155. As seen by referring to FIGS. 19 and 20 together, when locking member 375 is disposed at first lobe 395 (FIG. 19), cam gear 155 is restrained by locking member 375 (locking member 375 is in contact with the teeth of cam gear 155 and is said to be in a first locked position), and when locking member 375 is disposed at second lobe 400 (FIG. 20), cam gear 155 is unrestrained by locking member 375 (locking member 375 is in clearance with the teeth of cam gear 155 and is said to be in a second unlocked position). With cam gear 155 in the set position and locking member 375 in the first locked position, slave pole 305 can be assembled with master pole 300 with the respective cam gears 155 being properly aligned and then interconnected via the connecting gear 310.

During a first operation of motor 125, cam gear 155 of slave pole 305 is rotated counter-clockwise about its pivot 405 (with reference to FIGS. 19 and 20), which causes locking member 375 to be driven by the teeth of cam gear 155 out of first lobe 395 (FIG. 19) and to be spring loaded into second lobe 400 (FIG. 20), thereby resulting in cam gear 155 no longer being locked, and locking member 375 no longer being in operable communication with the teeth of cam gear 155.

Figure 21:
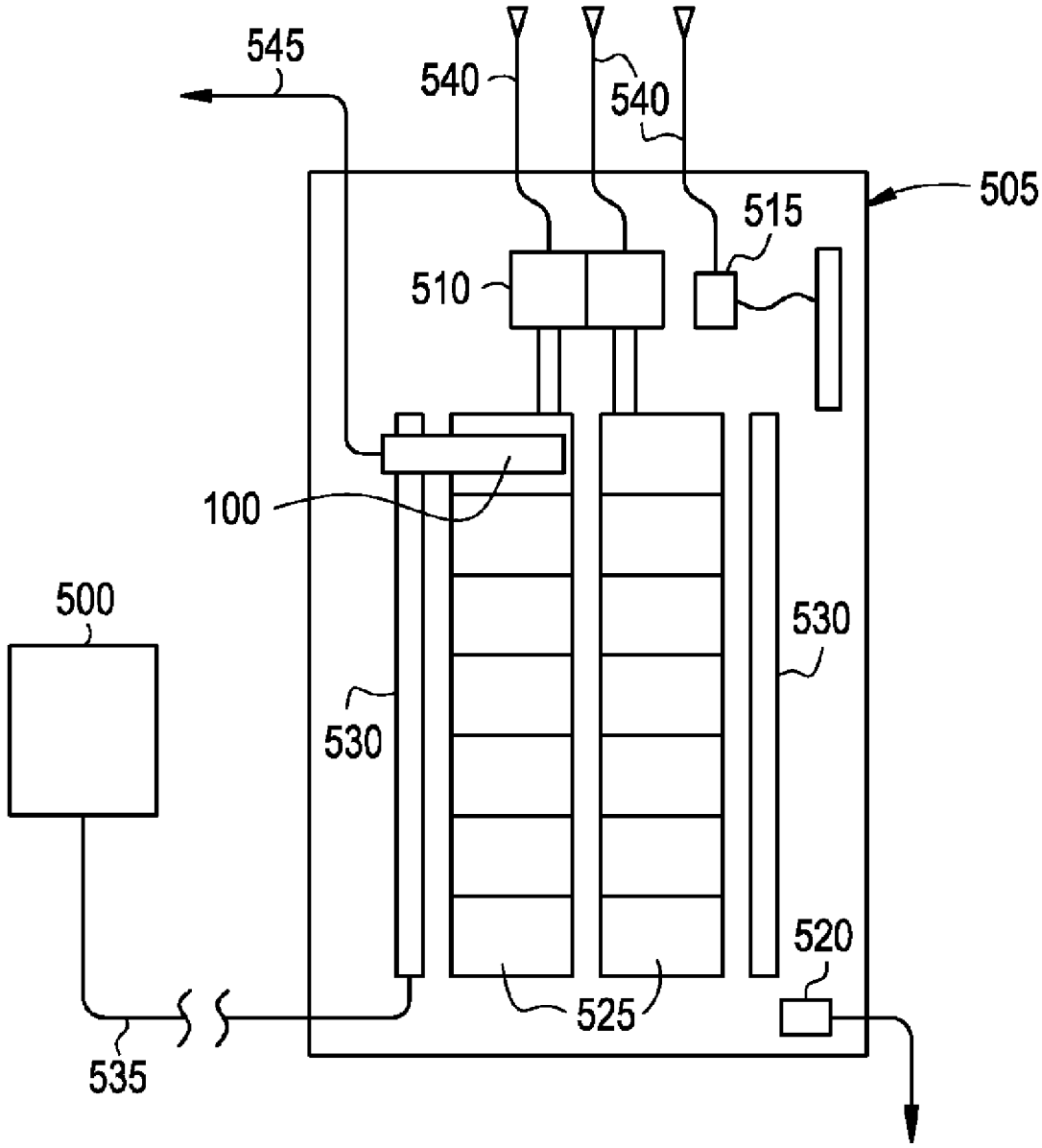
FIG. 21 depicts in block diagram view an exemplary electrical panel having installed therein a ROCB similar to that of FIG. 1, and a controller for use in accordance with an embodiment of the invention.

With reference now to FIG. 21, the interface between a ROCB 100 and a controller 500 will now be discussed. In an exemplary embodiment, FIG. 21 depicts an exemplary electrical panel 505 having a main power connection 510, a neutral connection 515, a ground connection 520, branch circuit connection bays 525, a ROCB 100 plugged into one of the branch circuit connection bays 525, and a communication bus 530 in signal communication with controller 500 via a communication line 535. While communication line 535 is depicted as a single line in FIG. 21, it will be appreciated from the discussion below that this is for illustration purposes only and that communication line 535 may be a plurality of communication signal lines. Line side power is provided to electrical panel 505 by cables 540, and load side power is distributed to a protected circuit (not shown but known in the art) by cable 545. ROCB 100 is in signal communication with communication bus 530 via communication port 120 (see FIG. 1 for example).

Figure 12:
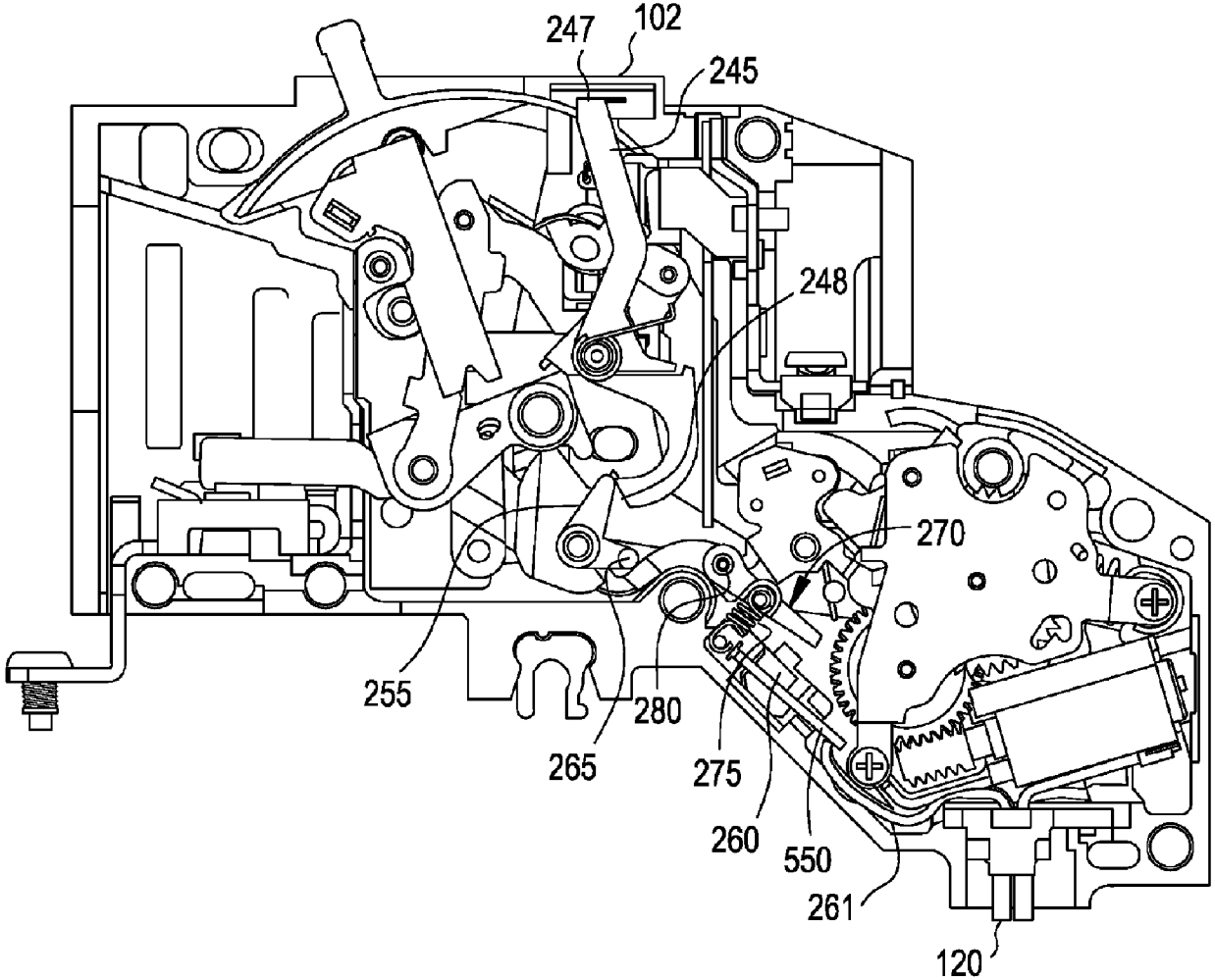
FIG. 12 depicts a view similar to that of FIG. 9, but with components in an alternative position.

As previously discussed, and with reference now to the various figures, but more specifically to FIGS. 9, 12 and 21, status switch 260 provides a switching signal to the controller 500 via wires 261 and communication port 120. In an exemplary ROCB 100, status switch 260 is in signal communication with a control circuit 550 via a printed circuit board (also generally depicted by reference numeral 550). In an embodiment, control circuit 550 includes a first circuit 555 depicted in FIG. 22, and a second circuit (dynamic braking circuit) 560 depicted in FIG. 23, which will now be discussed separately.

Figure 22:
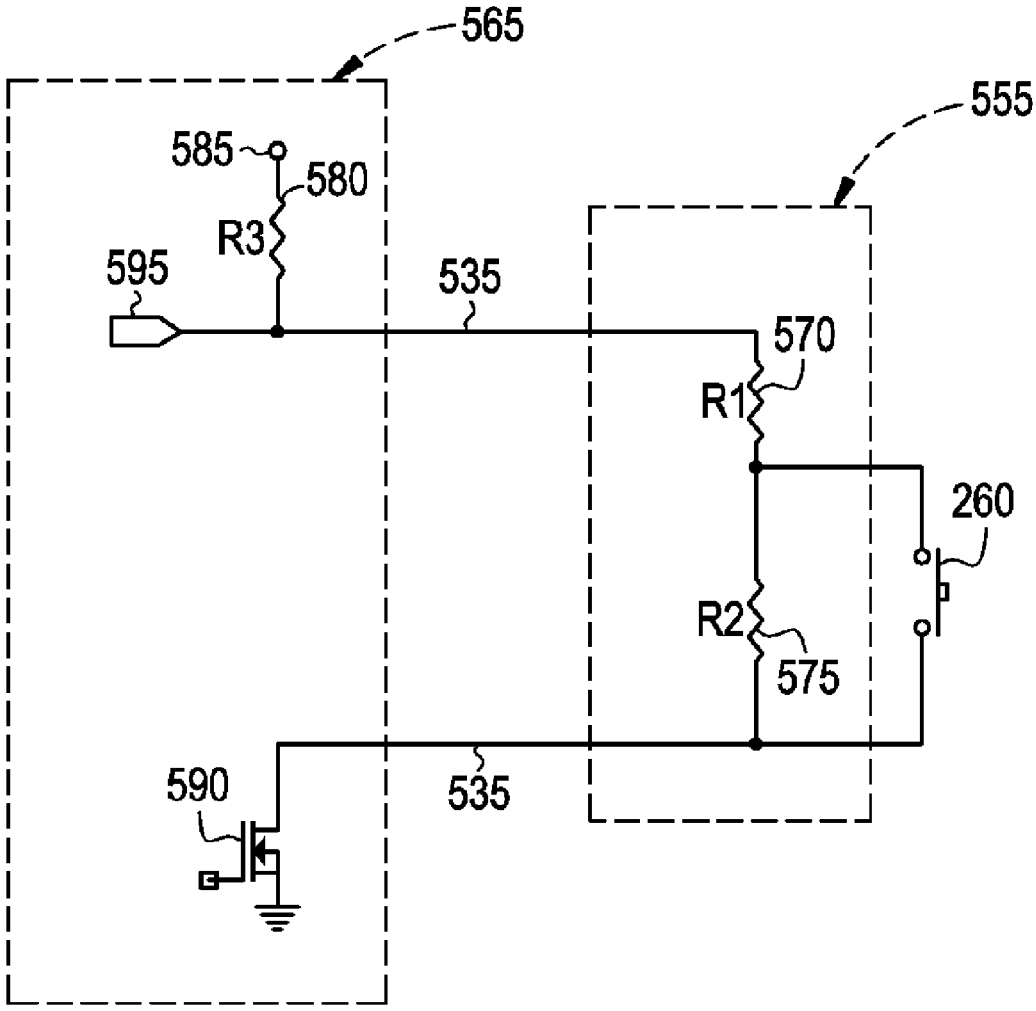
FIG. 22 depicts an exemplary schematic of an electrical circuit in accordance with an embodiment of the invention.

With reference to FIG. 22, first circuit 555 of control circuit 550 is in signal communication with status switch 260, and as previously discussed, status switch 260 is in operable communication with the main contacts 105, thereby resulting in control circuit 550 also being in operable communication with main contacts 105. In an embodiment, other components 565 (to be discussed in more detail below) are part of controller 500 and are in signal communication with first circuit 555 of control circuit 550 via communication lines 535. In an embodiment, first circuit 555 is an analog circuit having a network of impedances, such as a first resistor R1 570 and a second resistor R2 575 electrically connected in series. Status switch 260 is electrically connected in parallel with second resistor R2 575. As previously discussed, status switch 260 is open in response to main contacts 105 being closed, and vice versa. Thus, in response to the main contacts 105 being closed, first circuit 555 has a first impedance R1+R2, and in response to the main contacts 105 being open, first circuit 555 has a second different impedance R1, which is less than the first impedance R1+R2. While first circuit 555 is illustrated having resistive impedances, it will be appreciated that the scope of the invention is not so limited and that other electronic components having non-resistance impedance contributions may also be employed in accordance with the teachings of the present invention.

In view of the foregoing discussion, it will be appreciated that first circuit 555 of control circuit 550 provides logic to controller 500 for indicating a closed state at main contacts 105 in response to the operating mechanism 110 being in an on position and the main contacts 105 being closed, an open state at the main contacts 105 in response to the operating mechanism 110 being in an on position and the main contacts 105 being held open via the drive system 115, and an open state at main contacts 105 in response to the operating mechanism 110 being in an off position or a tripped position.

In an embodiment, R1 is 475 Ohms and R2 is 15 kilo-Ohms. However, it will be appreciated that other values for resistors R1 and R2 may be used not only for providing controller 500 with logic relating to the state of main contacts 105, but also for providing controller 500 with information about a particular ROCB 100, such as the ampere rating or voltage rating of the device, or the number of poles of the device, for example. Also, the absence of a ROCB 100 at a branch circuit connection bay 525 results in the absence of a connection to a first circuit 555, thereby resulting in an open circuit (high impedance) condition at the associated communication lines 535, which in turn provides controller 500 with information representative of the absence of a ROCB 100 at that particular branch circuit connection bay 525.

In an embodiment, the other electronic components 565 at controller 500 include a third resistor R3 580 for providing a voltage signal via a voltage reference 585, and an electronic switch 590, such as a MOSFET (metal oxide semiconductor field effect transistor) for example, for effecting a monitoring signal. A signal path 595 directs the monitoring signal to an analog-to-digital monitor circuit (not shown) at the controller 500 for decoding.

Figure 23:
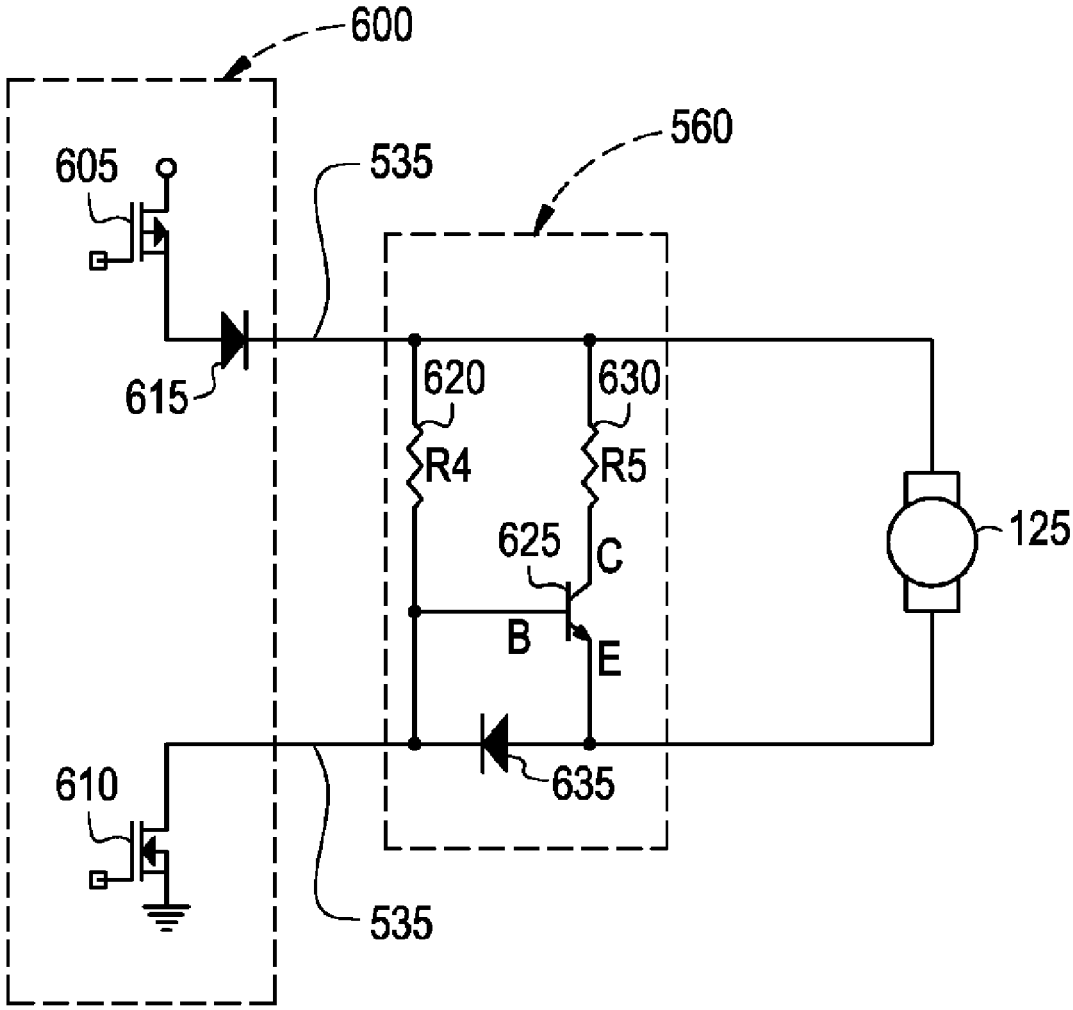
FIG. 23 depicts an exemplary schematic of another electrical circuit in accordance with an embodiment of the invention.

Referring now to FIG. 23, second circuit 560 of control circuit 550 is in signal and operable communication with motor 125. Second circuit 560 is also in signal communication with other electronic components 600 of controller 500 via communication lines 535. In an embodiment, the other electronics 600 include a line control switch 605, a load control switch 610, and a first diode 615. Second circuit 560, also herein referred to as a braking circuit, is connected in series between the line and load control switches 605, 610, and is connected across the line and load terminals of motor 125, such that when line and load control switches 605, 610 are closed, second circuit 560 is electrically in parallel with motor 125, and when line and load control switches 605, 610 are open, second circuit 560 is electrically in series with motor 125. By switching between a parallel connection and a series connection, second circuit 560 is configured to be inactive in response to the motor 125 being turned on, and active in response to the motor 125 being turned off. When active, second circuit 560 serves to dissipate residual inertial energy of the motor 125, thereby resulting in a dynamic braking action of the motor 125. In view of the foregoing discussion, it will be appreciated that second circuit 560 provides an energy dissipation path that is electrically in parallel with the motor 125, but that the dissipation path is not active until the motor 125 is turned off.

In an embodiment, second circuit 560 includes an impedance network 620, 630 in signal communication with an electronic switch 625, the combination of which making up the aforementioned energy dissipation path. More specifically, an embodiment of second circuit 560 utilizes a transistor for electronic switch 625, a first impedance such as resistor R4 620 for example connected in series with the base of transistor 625, a second impedance such as resistor R5 630 for example connected in series with the collector of transistor 625, and a diode 635 connected between the base and the emitter of transistor 625. While second circuit 560 is illustrated having resistive impedances, it will be appreciated that the scope of the invention is not so limited and that other electronic components having non-resistance impedance contributions may also be employed in accordance with the teachings of the present invention. In an embodiment, first resistor R4 is greater that second resistor R5. In an exemplary embodiment, R4 is 2.2 kilo-Ohms and R5 is 10 Ohms. However, other resistance values may be employed. In an embodiment, electronic switch 625 may be a NPN transistor, a MOSFET, a Darlington-type transistor, or a SCR (silicon controlled rectifier).

In response to line and load control switches 605, 610 being closed and motor 125 being turned on, the base of transistor 625 is kept low by load control switch 610 thereby keeping transistor 625 turned off and first resistor R4 620 in parallel with motor 125. The selection of a high impedance value for R4 is such that the energy sourced to the motor 125 is not significantly affected.

In response to the line and load control switches 605, 610 being open and motor 125 being turned off but continuing to rotate, the residual inertial energy of the motor 125 causes the motor 125 to act as a generator and to generate a back electromotive force at the terminals of the motor 125. As a result, a voltage is allowed to build up at the base of transistor 625, but not at the emitter of transistor 625 due to diode 635, which in turn allows transistor 625 to turn on and a current to flow through second resistor R5 630. As a result, the residual inertial energy of the motor 125 is electrically dissipated in second resistor R5 630, thereby resulting in a braking action of the motor 125.

Figure 24:
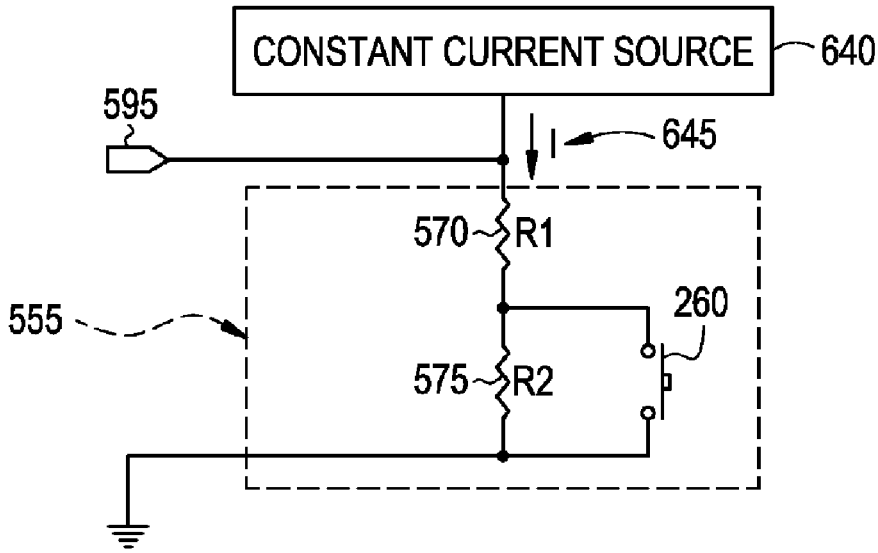
FIGS. 24–25 depict alternative embodiments to that depicted in FIG. 22.
Figure 25:
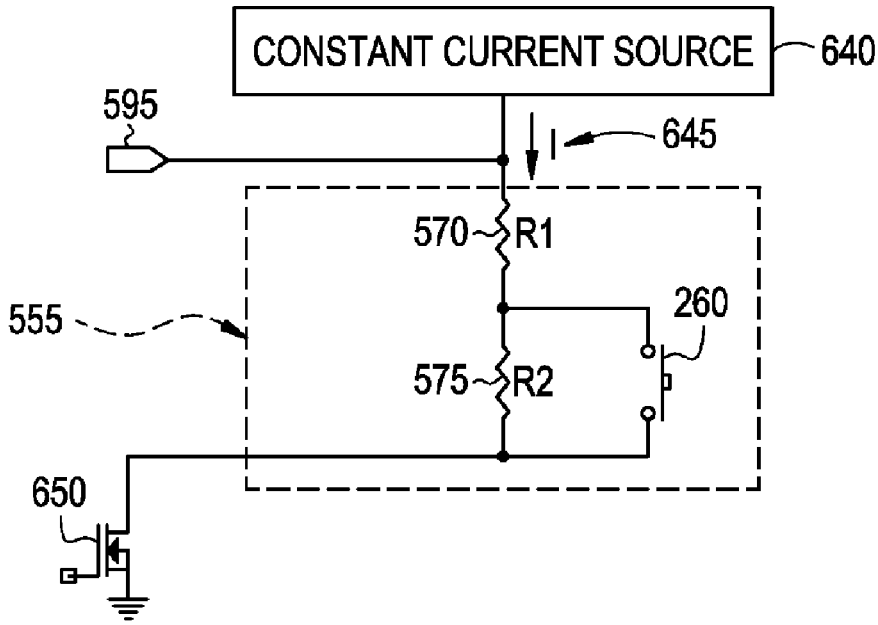

Referring now to FIGS. 24 and 25, which depict alternative embodiments to the embodiment depicted in FIG. 22, voltage reference 585 and resistor R3 580 may be replaced by a constant current source 640, which causes a constant current I 645 to flow through R1 and R2, or through R1 and status switch 260, depending on the state of status switch 260. As a result, signal path 595 provides controller 500 with a means to monitor the voltage drop across first circuit 555 (R1 and R2 in series, or just R1 with status switch 260 closed), thereby providing an alternative means for determining the state of main contacts 105. In the embodiment depicted FIG. 25, an electronic switch 650, such as a MOSFET for example, provides controller 500 with the ability to select or deselect a particular first circuit 555 of a particular ROCB 100 to monitor.

In view of the foregoing, it will be appreciated that some embodiments of the invention may include some of the following advantages: a unidirectional drive system for remotely operating a circuit breaker capable of monitoring the status of the breaker main contacts while the drive motor is energized; a status switch for providing logical information relating to the status of the breaker main contacts and for providing logical control for powering the motor on and off; an analog circuit for providing a control signal that also provides information relating to the configuration of the ROCB itself, such as the ampere rating, the voltage rating, or the pole configuration of the ROCB for example; an energy dissipation path for dissipating residual motor energy in response to the motor being turned off, thereby braking the motor and preventing the motor from undergoing an overdrive condition; and, an energy dissipation path for dissipating residual motor energy in response to the motor being turned off, thereby braking the motor and preventing the breaker main contacts from inadvertently changing state.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order from another. Furthermore, the use of the terms a, an, etc. do not denote a limitation of quantity, but rather denote the presence of at least one of the referenced item.

What is claimed is:

1. A circuit breaker configured to be remotely operated by a controller, the circuit breaker comprising:

a set of main contacts configured to connect between an electrical source and an electrical load;

an operating mechanism in operable communication to open and close the main contacts;

a remotely operable drive system configured to open and close the main contacts separate from actuation of the operating mechanism, the drive system comprising a motor responsive to first and second control signals, and a primary drive responsive to the motor and in operable communication to open and close the main contacts; and a control circuit in operable communication with the main contacts;

wherein the control circuit has a first impedance in response to the main contacts being closed and a second different impedance in response to the main contacts being open; and wherein the control circuit indicates a closed main contact state in response to the operating mechanism being in an on position and the main contacts being closed, and an open main contact state in response to the operating mechanism being in an on position and the main contacts being held open via the drive system.

2. The circuit breaker of claim 1, wherein the control circuit indicates an open main contact state in response to the operating mechanism being in an off position or a tripped position.

3. The circuit breaker of claim 1, wherein the control circuit is an analog circuit.

4. The circuit breaker of claim 1, wherein the control circuit comprises:

an impedance network; and a switch in signal communication with the impedance network;

wherein in response to the main contacts being closed, the switch has a first position thereby resulting in the impedance network having a first impedance, and in response to main contacts being open, the switch has a second position thereby resulting in the impedance network having a second different impedance.

5. The circuit breaker of claim 4, wherein:

the impedance network comprises two resistors connected in series; and the switch is connected in parallel with one of the two resistors.

6. The circuit breaker of claim 4, wherein:

the first impedance is greater than the second impedance.

7. The circuit breaker of claim 4, wherein:

the impedance network and switch define a first circuit that is configured to receive a constant current from a constant current source.

8. The circuit breaker of claim 1, wherein the control circuit is in operable communication with the main contacts and the motor.

9. A circuit breaker configured to be remotely operated by a controller, the circuit breaker comprising:

a set of main contacts configured to connect between an electrical source and an electrical load;

an operating mechanism in operable communication to open and close the main contacts;

a remotely operable drive system configured to open and close the main contacts separate from actuation of the operating mechanism, the drive system comprising a motor responsive to first and second control signals, and a primary drive responsive to the motor and in operable communication to open and close the main contacts; and a control circuit having a dynamic braking circuit and being in operable communication with the main contacts and the motor;

wherein the motor is configured to be turned on and off via a line control switch and a load control switch, and wherein the dynamic braking circuit is connected in series between the line and load control switches and configured to be inactive in response to the motor being turned on and active in response to the motor being turned off.

10. The circuit breaker of claim 9, wherein the dynamic braking circuit is configured to dissipate inertial energy of the motor in response to the motor being turned off, thereby resulting in a braking action of the motor.

11. The circuit breaker of claim 10, wherein the dynamic braking circuit comprises an energy dissipation path connected in parallel with the motor.

12. The circuit breaker of claim 11, wherein the energy dissipation path comprises an impedance connected in series with an electronic switch.

13. The circuit breaker of claim 12, wherein the impedance comprises a resistor.

14. The circuit breaker of claim 12, wherein in response to the motor being turned off but continuing to move, a back electromotive force generated at the motor terminals causes the electronic switch to turn on, thereby resulting in energy dissipation in the impedance and a braking action of the motor.

15. The circuit breaker of claim 12, wherein the electronic switch comprises a NPN transistor, a MOSFET, a Darlington-type transistor, or a SCR.

16. The circuit breaker of claim 12, wherein:

the electronic switch comprises a transistor; and in response to the motor being turned off but continuing to move, and a back electromotive force being generated at the motor terminals, the braking circuit is configured to allow a voltage to build up at the base of the transistor and to disallow a voltage to build up at the emitter of the transistor, thereby allowing the transistor to turn on and a current to flow through the impedance, which results in the residual inertial energy of the motor being dissipated and a braking action of the motor.

17. The circuit breaker of claim 12, wherein:

the electronic switch comprises a transistor;

the impedance comprises a first impedance connected in series with the base of the transistor, and a second impedance connected in series with the collector of the transistor; and the first impedance is greater than the second impedance.

18. A circuit breaker configured to be remotely operated by a controller, the circuit breaker comprising:

a set of main contacts configured to connect between an electrical source and an electrical load;

an operating mechanism in operable communication to open and close the main contacts;

a remotely operable drive system configured to open and close the main contacts separate from actuation of the operating mechanism, the drive system comprising a motor responsive to first and second control signals, ad a primary drive responsive to the motor and in operable communication to open and close the main contacts, the motor being configured to be turned on and off via a line control switch and a load control switch; and a control circuit in operable communication with the main contacts and the motor, the control circuit comprising a dynamic braking circuit connected in series between the line and load control switches and configured to be inactive in response to the motor being turned on and active in response to the motor being turned off.

19. The circuit breaker of claim 18, wherein:

the control circuit is further configured to indicate a closed main contact state in response to the operating mechanism being in an on position and the main contacts being closed, and an open main contact state in response to the operating mechanism being in an on position and the main contacts being held open via the drive system.

20. The circuit breaker of claim 18, wherein:

the dynamic braking circuit comprises an energy dissipation path connected in parallel with the motor, the energy dissipation path comprising an impedance connected in series with an electronic switch; and in response to the motor being turned off but continuing to move, a back electromotive force generated at the motor terminals causes the electronic switch to turn on, thereby resulting in dissipation of motor inertial energy in the impedance and a braking action of the motor.

* * * * *

UNITED STATES PATENT AND TRADEMARK OFFICE

CERTIFICATE OF CORRECTION

PATENT NO. : 7,019,606 B2
APPLICATION NO. : 10/907296
DATED : March 28, 2006
INVENTOR(S) : Williams et al.

It is certified that error appears in the above-identified patent and that said Letters Patent is hereby corrected as shown below:

Column 2: line 66, after "to" delete "that" and insert therefor --those--;
Column 13: line 7, after "greater" delete "that" and insert therefor --than--;
Column 14: line 57, after "to" insert --the--;
Column 16: line 24, after "signals," delete "ad" and insert therefor --and--;

Signed and Sealed this

Seventh Day of November, 2006

JON W. DUDAS
*Director of the United States Patent and Trademark Office*